US006997365B2

(12) United States Patent
Miller et al.

(10) Patent No.: US 6,997,365 B2
(45) **Date of Patent: *Feb. 14, 2006**

(54) CONTACT TRIP ASSEMBLY FOR FASTENING TOOL

(75) Inventors: Keven E. Miller, Forest Hill, MD (US); Glen V. Steinbrunner, Forest Hill, MD (US); Michael P. Baron, Phoenix, MD (US); Robert A. Berry, Mt. Airy, MD (US); Paul G. Gross, White Marsh, MD (US); Craig A. Schell, Baltimore, MD (US); C. Kerwin Braddock, Bel Air, MD (US); Charles L. Bradenbaugh, IV, York, PA (US); William D. Sauerwein, Phoenix, MD (US); John C. Funicello, Palm Bay, FL (US); James R. Niblett, Columbia, MD (US); Andrzej R. Wojcicki, Rosedale, MD (US); Adan Ayala, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/768,727

(22) Filed: Jan. 29, 2004

(65) Prior Publication Data

US 2004/0245312 A1 Dec. 9, 2004

Related U.S. Application Data

(63) Continuation of application No. 10/054,137, filed on Jan. 22, 2002, now Pat. No. 6,705,501.

(60) Provisional application No. 60/265,399, filed on Jan. 31, 2001, now abandoned, provisional application No. 60/338,896, filed on Nov. 6, 2001, now abandoned.

(51) Int. Cl.
*B21J 15/28* (2006.01)

(52) U.S. Cl. ..... 227/8; 227/129

(58) Field of Classification Search ..... 227/8, 227/129, 130, 142

See application file for complete search history.

(56) References Cited

U.S. PATENT DOCUMENTS 3,673,922 A * 7/1972 Doyle ..... 91/422
4,928,868 A * 5/1990 Kerrigan ..... 227/131

(Continued)

FOREIGN PATENT DOCUMENTS

WO WO 00/59687 A 10/2000

OTHER PUBLICATIONS

U. Matzdorf, European Search Report Application No. EP 02 25 0631, Sep. 21, 2004, The Hague.

(Continued)

*Primary Examiner*—Stephen F. Gerrity
*Assistant Examiner*—Brian Nash
(74) *Attorney, Agent, or Firm*—Adan Ayala

(57) ABSTRACT

A fastening tool including a housing, a magazine connected to the housing for storing a fastener, a driving mechanism disposed within the housing for driving the fastener into a workpiece, a trigger assembly pivotally attached to the housing for activating the driving mechanism, the trigger assembly comprising a main trigger, pivotally attached to the housing and a supplemental trigger pivotally attached to the main trigger; and a contact trip assembly comprising an upper contact trip contacting the supplemental trigger, a lower contact trip connected to the upper contact trip, wherein the upper and lower contact trips have teeth that mesh together for locking the upper and lower contact trips.

2 Claims, 18 Drawing Sheets

U.S. PATENT DOCUMENTS 5,181,450 A * 1/1993 Monacelli ..... 91/41
5,219,110 A * 6/1993 Mukoyama ..... 227/8
5,263,842 A 11/1993 Fealey
5,452,835 A 9/1995 Shkolnikov
5,715,982 A * 2/1998 Adachi ..... 227/8
5,785,228 A * 7/1998 Fa et al. ..... 227/8
6,209,770 B1 * 4/2001 Perra ..... 227/8

OTHER PUBLICATIONS

Annex to the European Search Report on European Patent Application No. EP 02 25 0631.

* cited by examiner

CONTACT TRIP ASSEMBLY FOR FASTENING TOOL

CROSS-REFERENCE TO RELATED APPLICATIONS

This application is a continuation of application Ser. No. 10/054,137, filed on Jan. 22, 2002, now U.S. Pat. No. 6,705,501, which in turn derives priority under 35 USC § 119(e) from U.S. Application Ser. No. 60/265,399, filed Jan. 31, 2001, now abandoned, and from U.S. Application Ser. No. 60/338,896, filed Nov. 6, 2001, now abandoned.

BACKGROUND OF THE INVENTION

The invention relates to fastening tools having contact trips and particularly to mechanisms for easily adjusting the contact trips.

Fastening tools are used for driving nails or staples into workpieces. It is well known in the art to provide such tools with a contact trip extending downwardly from the tool for contacting the workpiece and a separate trigger activated by the user's digits. Accordingly, the tool can be "programmed" to drive a nail only when the user has pushed the tool unto the workpiece and has activated the trigger.

At times, it is useful to adjust the length of the contact trip. Prior art solutions, such as the solution shown in U.S. Pat. No. 5,219,110, include providing a contact trip having an upper contact trip, a lower contact trip, and a rotatable element therebetween. As the element is rotated, the lower contact trip moves relative to the upper contact trip, thus adjusting the contact trip length.

SUMMARY OF THE INVENTION

It is an object of the invention to provide a contact trip that is easier to adjust than prior art contact trips.

In accordance with the present invention, an improved fastening tool is disclosed. The fastening tool includes a housing, a magazine connected to the housing for storing a fastener, a driving mechanism disposed within the housing for driving the fastener into a workpiece, a trigger assembly pivotally attached to the housing for activating the driving mechanism, the trigger assembly comprising a main trigger, pivotally attached to the housing and a supplemental trigger pivotally attached to the main trigger; and a contact trip assembly comprising an upper contact trip contacting the supplemental trigger, a lower contact trip connected to the upper contact trip, wherein the upper and lower contact trips have teeth that mesh together for locking the upper and lower contact trips.

Additional features and benefits of the present invention are described, and will be apparent from the accompanying drawings and the detailed description below.

BRIEF DESCRIPTION OF THE DRAWINGS

The accompanying drawings illustrate preferred embodiments of the invention according to the practical application of the principles thereof, and in which:

FIG. 16 is a cross-sectional view of the contact trip assembly of FIG. 15, where

FIG. 17 is a cross-sectional view of a further embodiment of a contact trip assembly according to the invention, where

FIG. 18 illustrates another embodiment of a contact trip assembly according to the invention, where

FIG. 20 is a cross-sectional view of the contact trip assembly of FIG. 19, where

FIG. 21 is a cross-sectional view of another embodiment of a contact trip assembly according to the invention, where

FIG. 22 illustrates a further embodiment of a contact trip assembly according to the invention, where

FIG. 23 illustrates another embodiment of a contact trip assembly according to the invention, where

FIG. 24 is a cross-sectional view of a further embodiment of a contact trip assembly according to the invention, where

FIG. 26 illustrates a further embodiment of a contact trip assembly according to the invention, where

DETAILED DESCRIPTION

Figure 1:
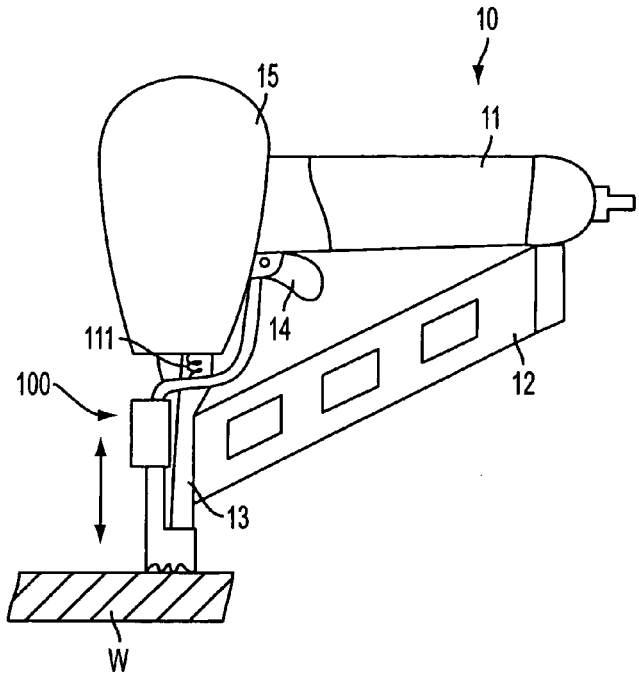
FIG. 1 is a side view of a fastening tool including a first embodiment of a contact trip assembly according to the invention.

The invention is now described with reference to the accompanying figures, wherein like numerals designate like parts. FIG. 1 shows a fastening tool 10 comprising a main housing 15 which covers the driving mechanism (not shown) for driving a fastener, such as a nail or staple, and which includes a handle 11, a nosepiece 13 below the housing 15, a magazine 12 connected to the nosepiece 13 and the handle 11, and a trigger assembly 14 disposed on the housing 15 and/or handle 11 for activating the driving mechanism as is well known in the art. Persons skilled in the art should recognize that the driving mechanism can be a pneumatic-based system, such as the ones shown in U.S. Pat. No. 3,673,922 or 5,181,450, or an electric system, such as the ones shown in U.S. Pat. No. 4,928,868. The teachings from those patents are wholly incorporated herein by reference.

Preferably, nosepiece 13 has rods 13R (see FIG. 2) which are received within channels (not shown) in the magazine 12. Fastening tool 10 also comprises a first embodiment of a contact trip 100 according to the invention.

Figure 14:
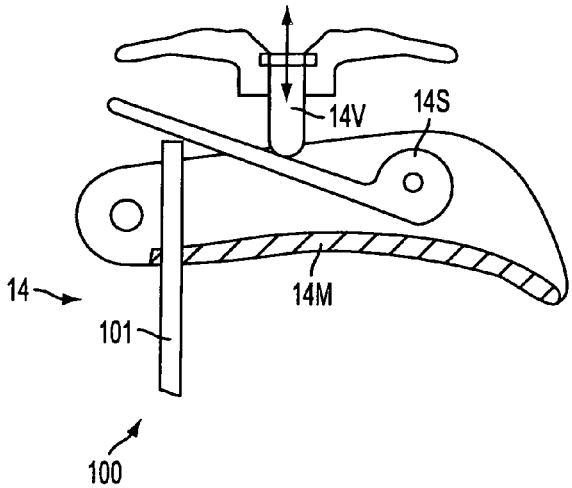
FIG. 14 illustrates a typical trigger assembly.

Referring to FIG. 14, the trigger assembly 14 may have a main trigger 14M pivotally attached to the housing 15 or handle 11 and a supplemental trigger 14S pivotally attached to the main trigger 14M. As discussed below, when main trigger 14M and contact trip 100 are activated, supplemental trigger 14S will move valve 14V, thus activating the driving mechanism. Persons skilled in the art will recognize that valve 14V will be a switch if the driving mechanism is an electric system, or an airflow-control valve if the driving mechanism is a pneumatic system. Persons skilled in the art will recognize that the operation of trigger assembly 14 in combination with contact trip assembly 100 is well known in the art, and is described in U.S. Pat. No. 5,785,228, which is wholly incorporated by reference herein.

Figure 2:
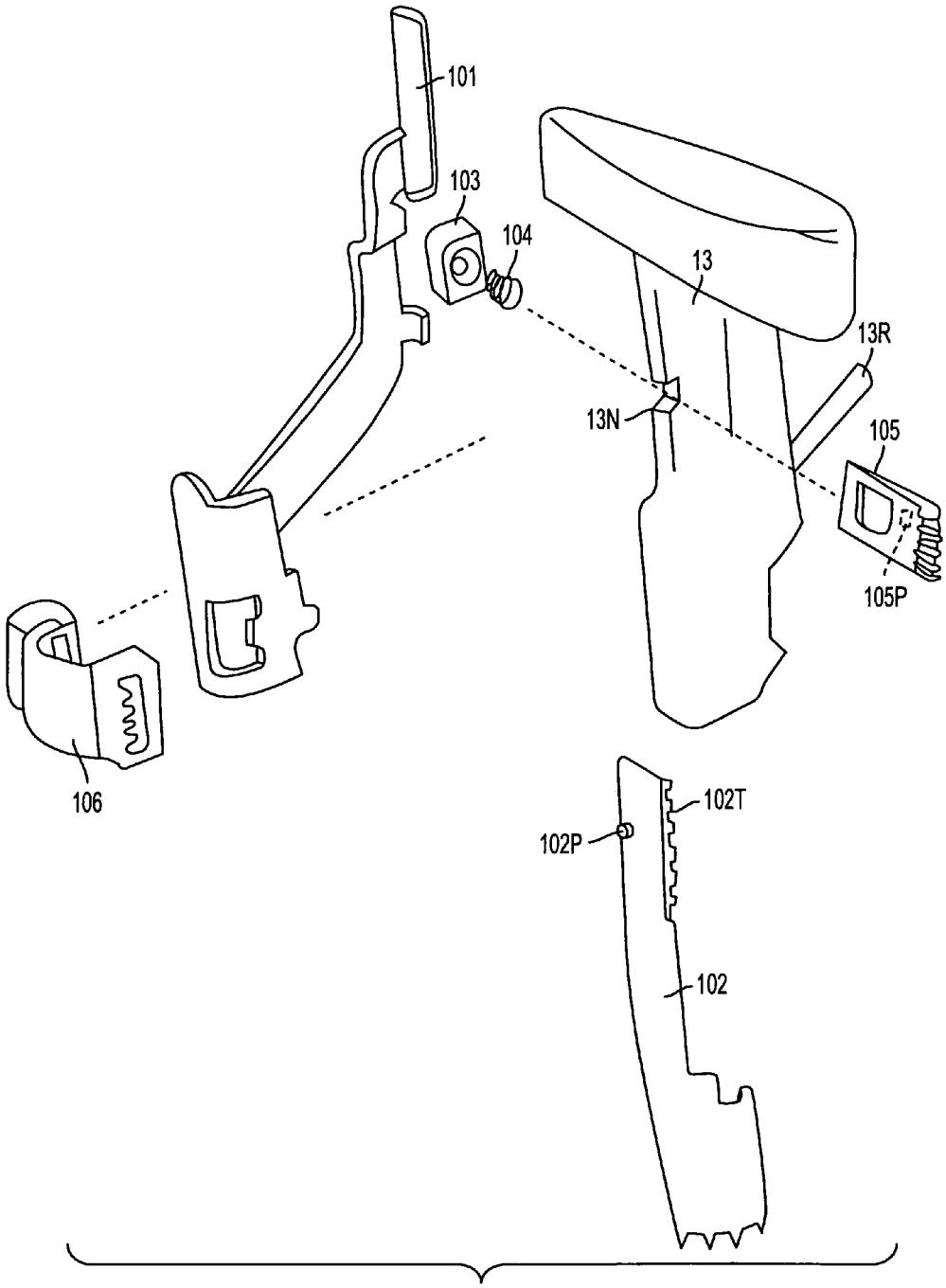
FIG. 2 is an exploded view of the contact trip assembly of FIG. 1.
Figure 4:
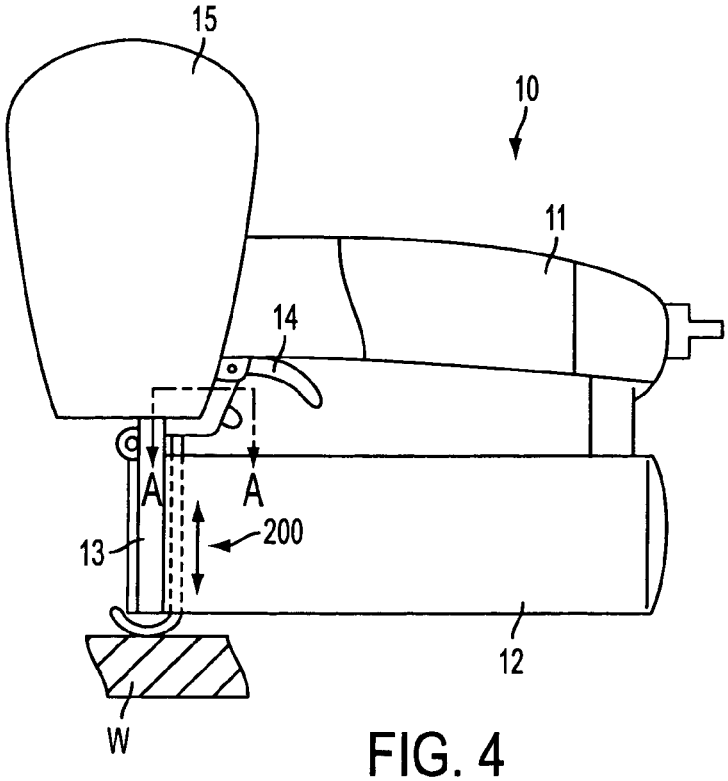
FIG. 4 is a side view of a fastening tool including another embodiment of a contact trip assembly according to the invention.
Figure 5:
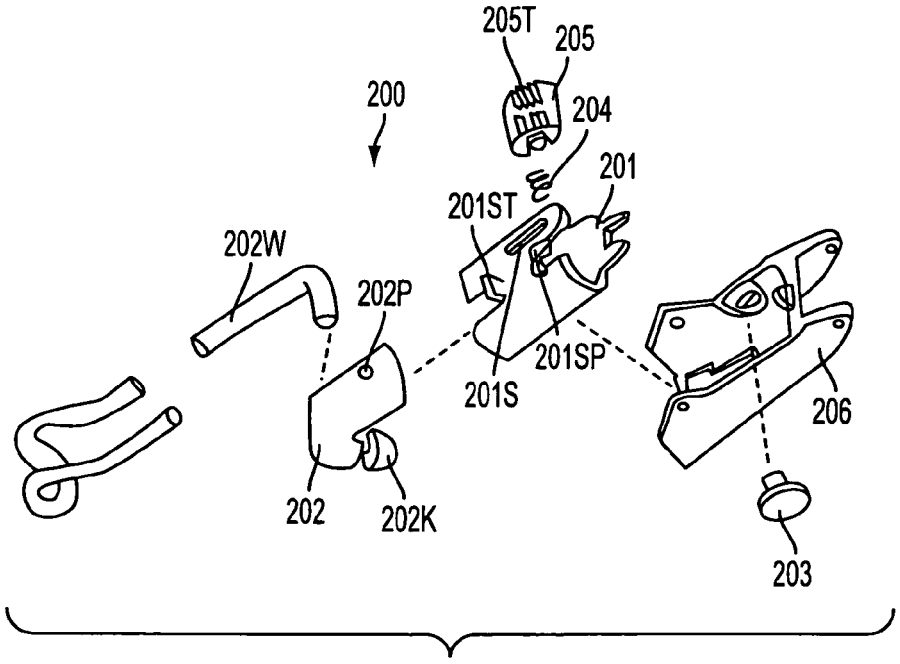
FIG. 5 is an exploded rear perspective view of the contact trip assembly of FIG. 4.
Figure 6:
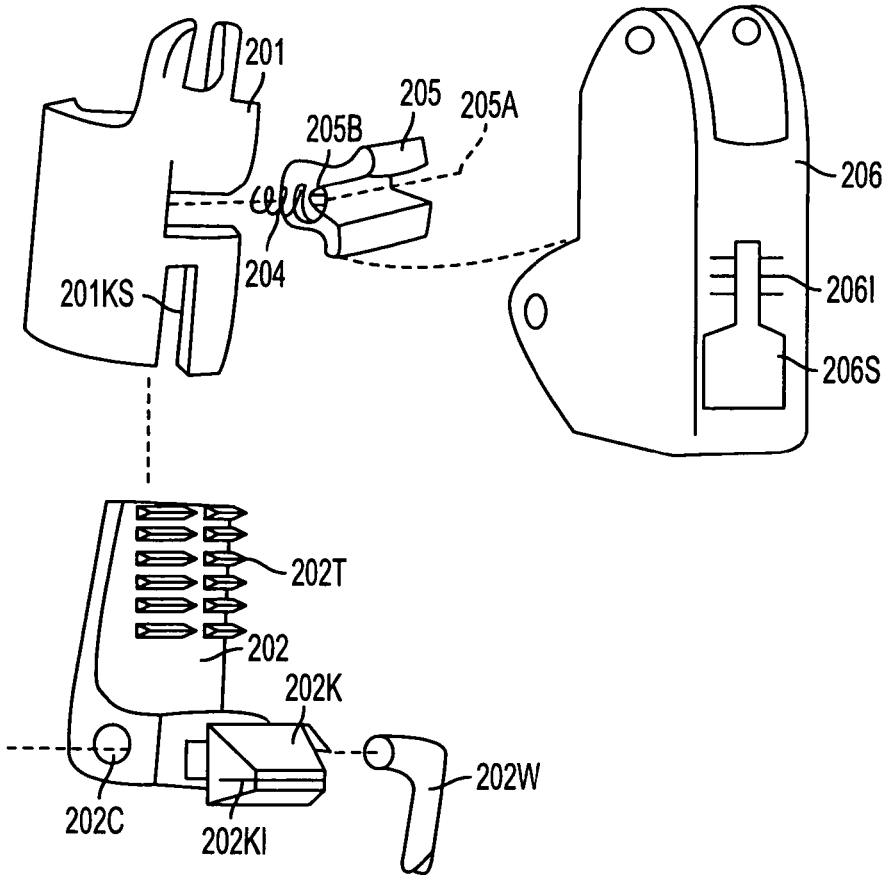
FIG. 6 is an exploded front perspective view of the contact trip assembly of FIG. 4.

Referring to FIGS. 1–3, the contact trip assembly 100 preferably has an upper contact trip 101 for contacting supplemental trigger 14S and a lower contact trip 102 for contacting a workpiece W. The contact trip assembly 100 is preferably slidably attached to the housing 15 and/or nosepiece 13 so that it slides vertically when the lower contact trip 102 contacts a workpiece and the user pushes the fastening tool 10 unto the workpiece W. A spring 111 may be disposed between housing 15 and/or nosepiece 13 and contact trip assembly 100 to bias contact trip assembly 100 downwardly towards the workpiece W.

Upper contact trip 101 may carry an adjuster 105. Preferably adjuster 105 has teeth 105T for meshing with teeth 102T disposed on lower contact trip 102. This connection may be disposed within upper contact trip 101 as shown in FIG. 3.

Upper contact trip 101 may also carry a cover 106. Preferably cover 106 has hooks 106H that latch onto upper contact trip 101 in a snap-fit manner. Cover 106 may retain adjuster 105 therewithin.

Figure 3A:
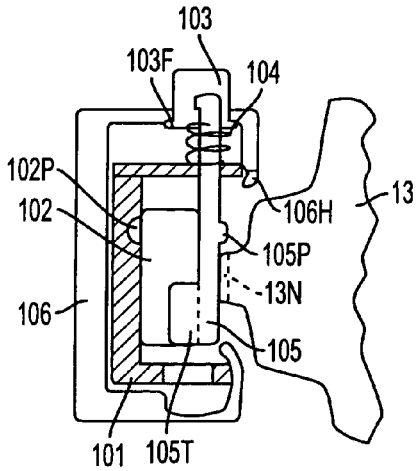
FIG. 3 is a cross-sectional view of the contact trip assembly of FIG. 1, along line C—C as shown in FIG. 2.

A button 103 is preferably disposed between upper contact trip 101 and cover 106 for moving adjuster 105. Button 103 may be directly connected to adjuster 105 so that they move in conjunction, e.g., a press-fit junction or a friction junction. Alternatively, button 103 may receive adjuster 105 as shown in FIG. 3A to form a mechanical connection.

Button 103 may be kept within cover 106 by a flange 103F, which prevents button 103 from escaping.

Alternatively, a spring 104 may be disposed between adjuster 105 and button 103, and received within button 103. Accordingly, the mechanical connection shown in FIG. 3A cannot be separated unless the spring 104 is separated from button 103. The spring 104 contacts cover 106 and biases button 103 outwardly, thus biasing adjuster 105 towards the meshing position. Persons skilled in the art shall recognize that button 103 may be disposed directly on upper contact trip 101 or in any other place so long as it can move adjuster 105.

Cover 106 may be alternatively held in place by the button/adjuster assembly. In other words, since adjuster 105 cannot escape from the upper contact trip 101, the button 103 will maintain contact with cover 106 and thus preventing cover 106 from detaching. Alternatively, cover 106 may be held in place by rivets, screws or other fastening means.

Figure 3B:
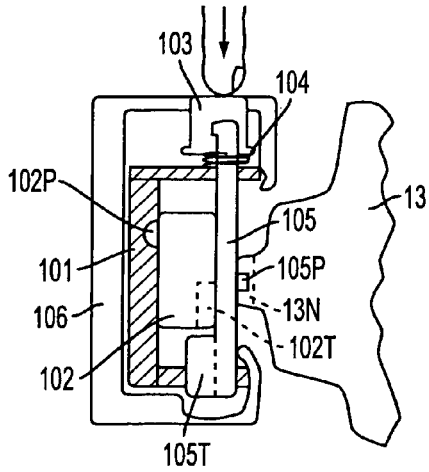

FIG. 3A shows adjuster 105 meshing with lower contact trip 102. If the user desires to change the overall length of the contact trip assembly 100, the user would push button 103 as shown in FIG. 3B. The button 103 moves adjuster 105 until its teeth 105T do not engage with the teeth 102T of lower contact trip 102. The user can then move the lower contact trip 102 to the desired position and let go of button 103. Spring 104 will move button 103 outwardly and adjuster 105 back to the meshing position.

Persons skilled in the art should recognize that it is preferred to move the adjuster 105 along a direction substantially parallel to the teeth 105T and/or substantially perpendicular to the direction of movement for the contact trip assembly 100. However, such persons will also recognize that the movement of adjuster 105 can be changed to meet other technical, ergonomic or preferential requirements. For example, teeth 105T and 102T may be inclined relative to the direction of movement of button 103, in order to increase the contact area between teeth 105T and 102T. In such case, the adjuster 105 could move along a direction substantially perpendicular to the direction of movement for the contact trip assembly 100, yet in a direction that is not parallel to the teeth 105T.

Persons skilled in the art should realize that adjuster 105 may be disposed on lower contact trip 102 to engage the upper contact trip 101.

It may also be useful to provide adjuster 105 with a protrusion 105P that engages a notch 13N in nosepiece 13 when adjuster 105 is moved to the disengaged position. In this manner, the upper contact trip 101 cannot move upwardly and unintendedly engage the trigger assembly 14 during adjustment. Persons skilled in the art will recognize that the same result will be achieved if adjuster 105 is provided with a notch that engages a protrusion on the nosepiece.

Referring to FIGS. 2–3, it may also be useful to provide lower contact trip 102 with a protrusion 102P which is received within a slot (not shown) in upper contact trip 101. Such protrusion 102P will slide along the slot and limit the vertical movement of lower contact trip 102 when adjuster 105 is disengaged. Accordingly, the protrusion 102P may also prevent the lower contact trip 102 from becoming disconnected from upper contact trip 101. Persons skilled in the art will recognize that the same result will be achieved if lower contact trip 101 is provided with a slot that receives a protrusion on upper contact trip 101.

Figure 23A:
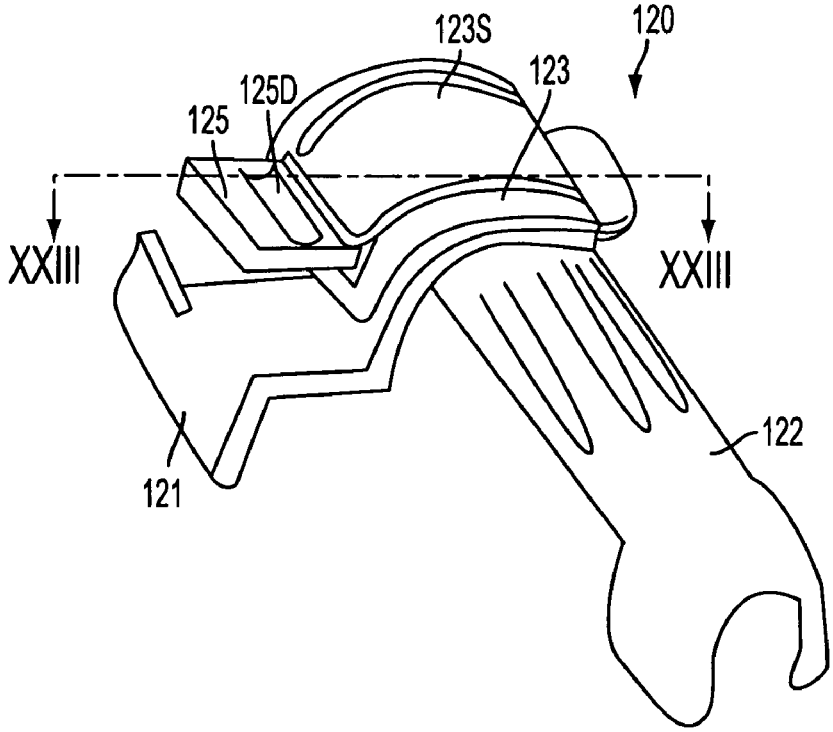
FIGS. 23A–B show a perspective view of the contact trip assembly and a cross-sectional view of the contact trip assembly along line XXIII—XXIII of FIG. 23A, respectively.

FIG. 23 illustrates another embodiment of the invention, where like numerals refer to like parts. The teachings of the previous embodiments discussed above are fully incorporated herein.

In such embodiment, the contact trip assembly 120 preferably has an upper contact trip 121 for contacting supplemental trigger 14S and a lower contact trip 122 for contacting a workpiece W. The contact trip assembly 120 is preferably slidably attached to the housing 15 and/or nosepiece 13 so that it slides vertically when the lower contact trip 122 contacts a workpiece and the user pushes the fastening tool 10 unto the workpiece W. A spring (not shown) may be disposed between housing 15 and/or nosepiece 13 and contact trip assembly 120 to bias contact trip assembly 120 downwardly towards the workpiece W.

Upper contact trip 121 may carry an adjuster 125. Preferably adjuster 125 has teeth 125T for meshing with teeth 122T disposed on lower contact trip 122. This connection may be disposed within upper contact trip 121 as shown in FIG. 23B.

Upper contact trip 121 may also carry a cover 123. Preferably cover 123 wraps around the front part of the upper contact trip 121.

Preferably adjuster 125 extends through upper contact trip 121 and cover 123.

Figure 23B:
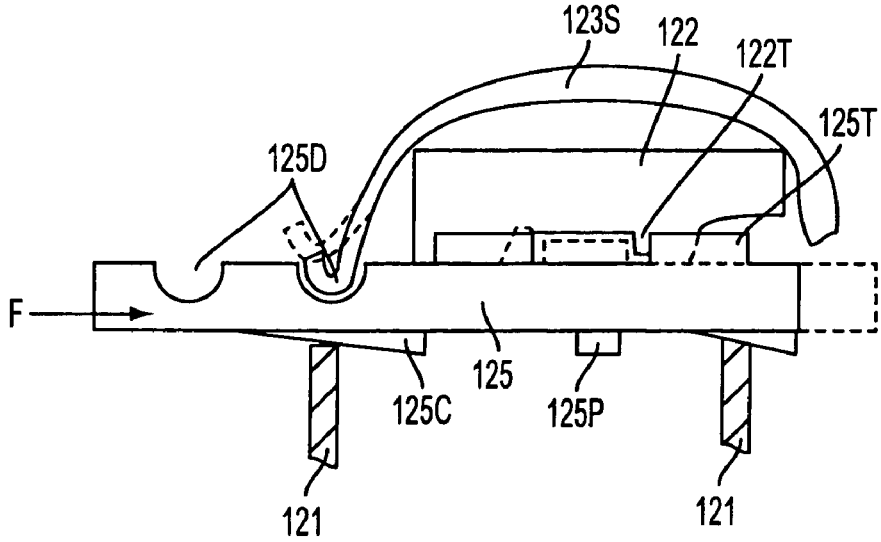

FIG. 23B shows adjuster 125 meshing with lower contact trip 122. If the user desires to change the overall length of the contact trip assembly 120, the user would push adjuster 125 along direction F. The adjuster 125 would then move until its teeth 125T do not engage with the teeth 122T of lower contact trip 122. The user can then move the lower contact trip 122 to the desired position. To lock the desired position, the user would pull adjuster 125 along the direction opposite to direction F, in order to engage teeth 122T, 125T.

Cover 123 may have a spring 123S for maintaining adjuster 125 in an engaged position and a disengaged position. Adjuster 125 may have notches 125D for receiving the spring 123S. The notches 125D and/or spring 123S may have a curved profile so that they can disengage easily upon movement of adjuster 125, rather than requiring the user to pull on the spring 123S. Accordingly, as the user pushes adjuster 125 towards the disengaged position, spring 123S pops out of notch 125D, rides along the surface of adjuster 125 and springs back into a second notch 125D, retaining the adjuster 125 in the disengaged position.

Adjuster 125 may have a cam ramp 125C that contacts upper contact trip 121. Such cam ramp 125C is preferably arranged so that it takes up any clearance or gaps when adjuster 125 is in the engaged position.

Persons skilled in the art should recognize that it is preferred to move the adjuster 125 along a direction substantially parallel to the teeth 125T and/or substantially perpendicular to the direction of movement for the contact trip assembly 120. However, such persons will also recognize that the movement of adjuster 125 can be changed to meet other technical, ergonomic or preferential requirements. For example, teeth 125T and 122T may be inclined relative to the direction of movement of adjuster 125, in order to increase the contact area between teeth 125T and 122T. In such case, the adjuster 125 could move along a direction substantially perpendicular to the direction of movement for the contact trip assembly 120, yet in a direction that is not parallel to the teeth 125T.

Persons skilled in the art should realize that adjuster 125 may be disposed on lower contact trip 122 to engage the upper contact trip 121.

It may also be useful to provide adjuster 125 with a protrusion 125P that engages a notch 13N in nosepiece 13 when adjuster 125 is moved to the disengaged position. In this manner, the upper contact trip 121 cannot move upwardly and unintendedly engage the trigger assembly 14 during adjustment. Persons skilled in the art will recognize that the same result will be achieved if adjuster 125 is provided with a notch that engages a protrusion on the nosepiece.

It may also be useful to provide lower contact trip 122 with a protrusion (not shown) which is received within a slot (not shown) in upper contact trip 121. Such protrusion will slide along the slot and limit the vertical movement of lower contact trip 122 when adjuster 125 is disengaged. Accordingly, the protrusion may also prevent the lower contact trip 122 from becoming disconnected from upper contact trip 121. Persons skilled in the art will recognize that the same result will be achieved if lower contact trip 121 is provided with a slot that receives a protrusion on upper contact trip 121.

Figure 25:
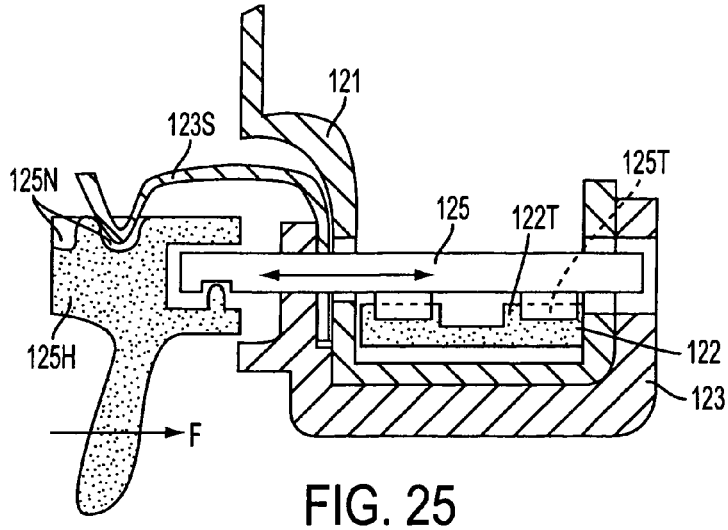
FIG. 25 is a cross-sectional view of another embodiment of a contact trip assembly according to the invention, where the contact trip assembly is in the engaged position.

Persons skilled in the art should recognize that the above-described elements may be rearranged and still obtain the same result. Referring to FIG. 25, a handle 125H may be attached to adjuster 125. Handle 125H may have notches 125N for receiving spring 123S. Persons skilled in the art will recognize that spring 123S is not integral with cover 123 in this arrangement, but captured by adjuster 125T, cover 123 and upper contact trip 121. Nevertheless, the method of operation remains the same.

FIG. 24 illustrates another embodiment of the invention, where like numerals refer to like parts. The teachings of the previous embodiments discussed above are fully incorporated herein.

In such embodiment, the contact trip assembly 130 preferably has an upper contact trip 131 for contacting supplemental trigger 14S and a lower contact trip 132 for contacting a workpiece W. The contact trip assembly 130 is preferably slidably attached to the housing 15 and/or nosepiece 13 so that it slides vertically when the lower contact trip 132 contacts a workpiece and the user pushes the fastening tool 10 unto the workpiece W. A spring (not shown) may be disposed between housing 15 and/or nosepiece 13 and contact trip assembly 130 to bias contact trip assembly 130 downwardly towards the workpiece W.

Upper contact trip 131 may carry an adjuster 135. Preferably adjuster 135 has teeth 135T for meshing with teeth 132T disposed on lower contact trip 132. This connection may be disposed within upper contact trip 131 as shown in FIG. 24.

Adjuster 135 may be attached to a cover 135C, which covers adjuster 135 and portions of upper and lower contact trips 131, 132. Cover 135C may have a notch 135N that receives one end of adjuster 135. A pin 135P and/or grommet 136G may capture the other end of adjuster 135 within cover 135C. Accordingly, adjuster 135 and cover 135C will preferably move in unison.

Figure 24A:
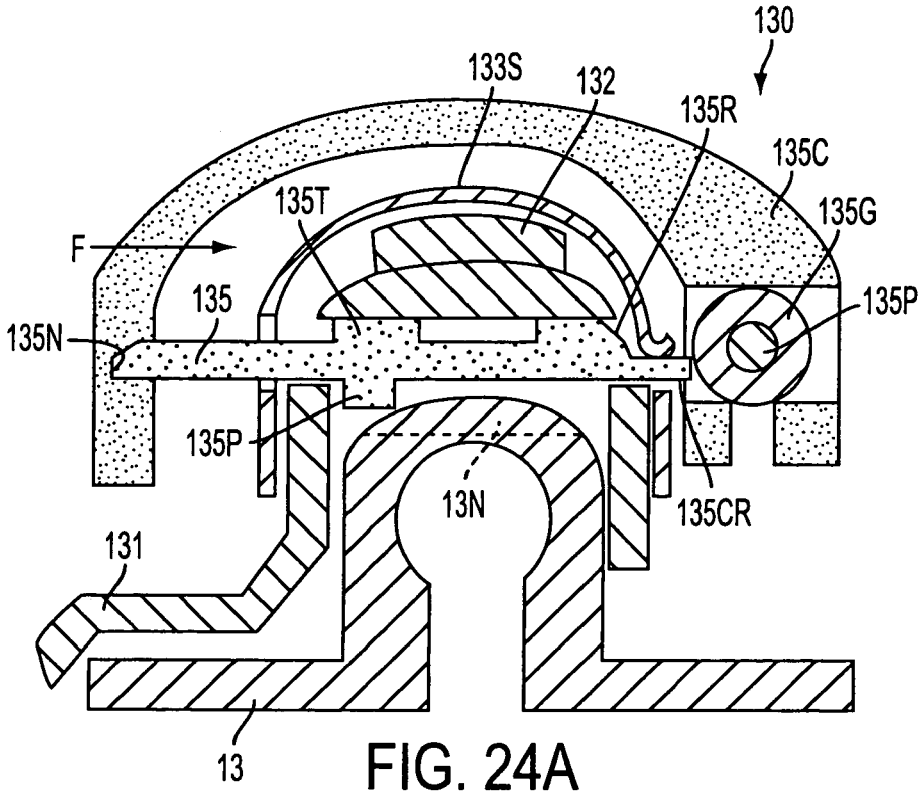
FIGS. 24A–B show the engaged and disengaged contact trip assembly, respectively.
Figure 24B:
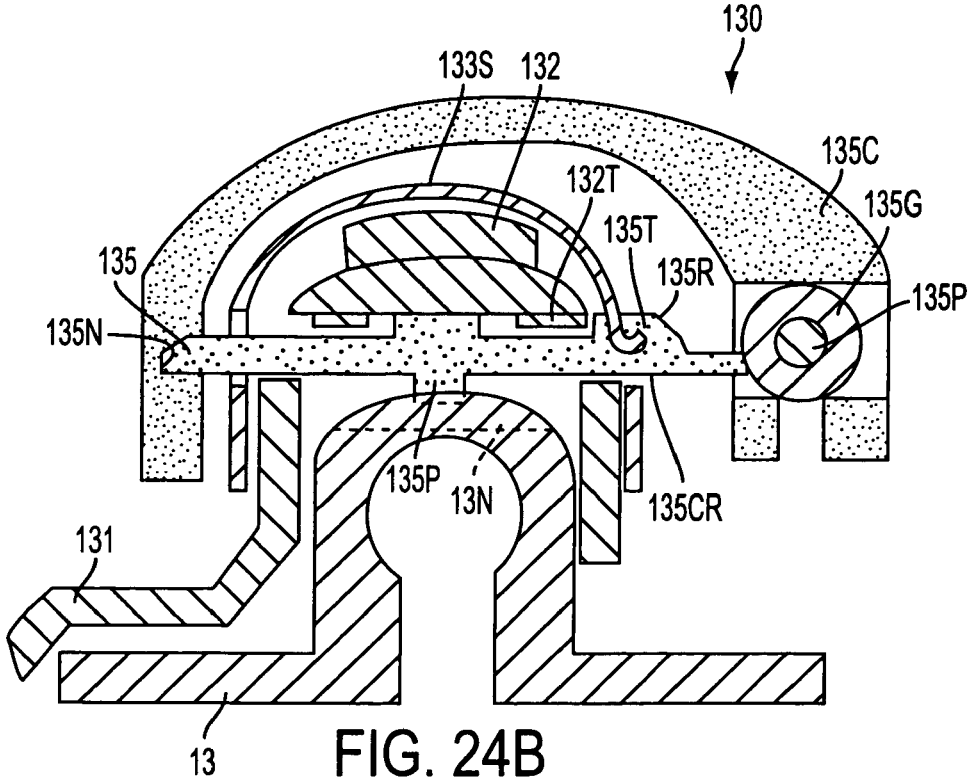

FIG. 24A shows adjuster 135 meshing with lower contact trip 132. If the user desires to change the overall length of the contact trip assembly 130, the user would push adjuster 135 (and cover 135C) along direction F. The adjuster 135 would then move until its teeth 135T do not engage with the teeth 132T of lower contact trip 132, as shown in FIG. 24B. The user can then move the lower contact trip 132 to the desired position. To lock the desired position, the user would pull adjuster 135 along the direction opposite to direction F, in order to engage teeth 132T, 135T.

Upper contact trip 131 may also carry a spring 133S. Preferably spring 133S wraps around the front part of the upper contact trip 131. Spring 133S may be disposed between adjuster 135 and cover 135C.

Preferably, spring 133S maintains adjuster 135 in an engaged position and/or a disengaged position. Contrary to the previous embodiment, adjuster 135 does not have notches for receiving the spring 133S.

Instead, spring 133S rests on a surface of adjuster 135. To move to the disengaged position, the user would have to move spring 133S onto teeth 135T. A ramp 135R is disposed on the teeth 135T to facilitate such action. Persons skilled in the art will recognize that, even with the ramp 135R, it should be difficult to move adjuster 135 unintentionally. This can be achieved by increasing spring force, increasing the ramp angle, etc.

Accordingly, as the user pushes adjuster 135 towards the disengaged position, spring 123S rides along ramp 135R onto teeth 135T. The spring 133S will then rest on teeth 135T, preferably retaining the adjuster 125 in the disengaged position.

Adjuster 135 may have a cam ramp 135CR that contacts upper contact trip 131. Such cam ramp 135CR is preferably arranged so that it takes up any clearance or gaps when adjuster 135 is in the engaged position.

Persons skilled in the art should recognize that it is preferred to move the adjuster 135 along a direction substantially parallel to the teeth 135T and/or substantially perpendicular to the direction of movement for the contact trip assembly 130. However, such persons will also recognize that the movement of adjuster 135 can be changed to meet other technical, ergonomic or preferential requirements. For example, teeth 135T and 132T may be inclined relative to the direction of movement of adjuster 135, in order to increase the contact area between teeth 135T and 132T. In such case, the adjuster 135 could move along a direction substantially perpendicular to the direction of movement for the contact trip assembly 130, yet in a direction that is not parallel to the teeth 135T.

Persons skilled in the art should realize that adjuster 135 may be disposed on lower contact trip 132 to engage the upper contact trip 131.

It may also be useful to provide adjuster 135 with a protrusion 135P that engages a notch 13N in nosepiece 13 when adjuster 135 is moved to the disengaged position. In this manner, the upper contact trip 131 cannot move upwardly and unintendedly engage the trigger assembly 14 during adjustment. Persons skilled in the art will recognize that the same result will be achieved if adjuster 135 is provided with a notch that engages a protrusion on the nosepiece.

It may also be useful to provide lower contact trip 132 with a protrusion (not shown) which is received within a slot (not shown) in upper contact trip 131. Such protrusion will slide along the slot and limit the vertical movement of lower contact trip 132 when adjuster 135 is disengaged. Accordingly, the protrusion may also prevent the lower contact trip 132 from becoming disconnected from upper contact trip 131. Persons skilled in the art will recognize that the same result will be achieved if lower contact trip 131 is provided with a slot that receives a protrusion on upper contact trip 131.

Figure 27:
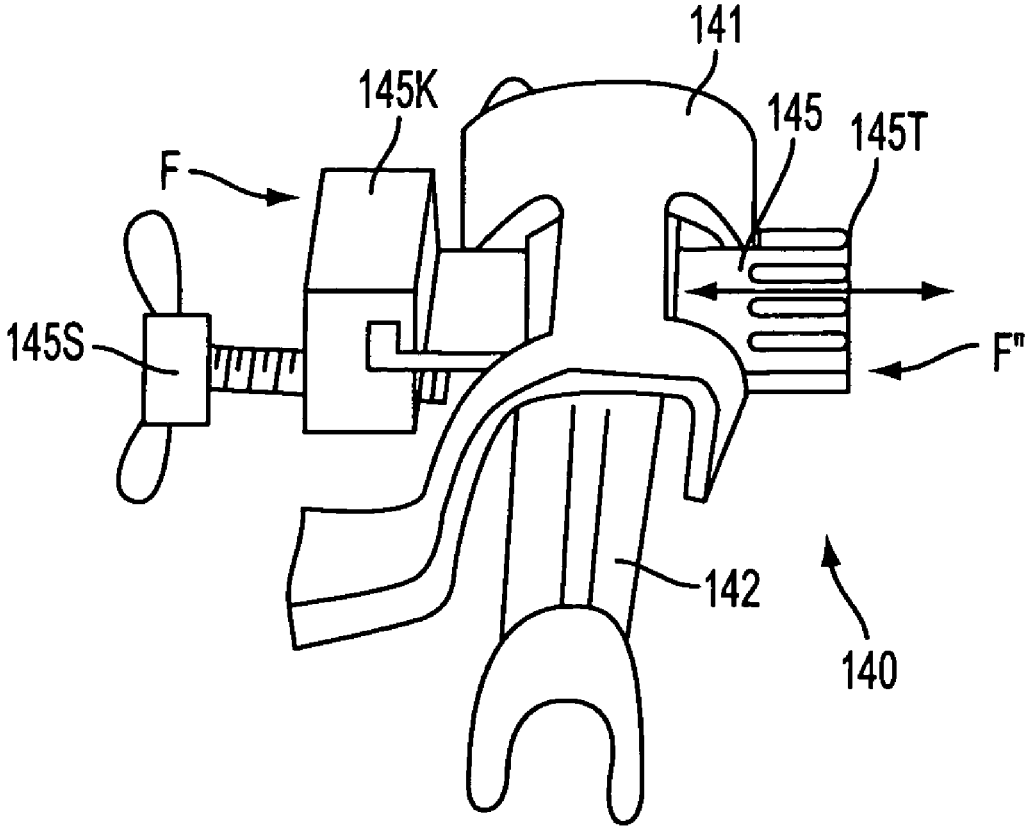
FIG. 27 is a front perspective view of another embodiment of a contact trip assembly according to the invention.

FIG. 27 illustrates another embodiment of the invention, where like numerals refer to like parts. The teachings of the previous embodiments discussed above are fully incorporated herein.

In such embodiment, the contact trip assembly 140 preferably has an upper contact trip 141 for contacting supplemental trigger 14S and a lower contact trip 142 for contacting a workpiece W. The contact trip assembly 140 is preferably slidably attached to the housing 15 and/or nosepiece 13 so that it slides vertically when the lower contact trip 142 contacts a workpiece and the user pushes the fastening tool 10 unto the workpiece W. A spring (not shown) may be disposed between housing 15 and/or nosepiece 13 and contact trip assembly 140 to bias contact trip assembly 140 downwardly towards the workpiece W.

Upper contact trip 141 may carry an adjuster 145. Preferably adjuster 145 has teeth 145T for meshing with teeth (not shown) disposed on lower contact trip 142. This connection may be disposed within upper contact trip 141. Preferably adjuster 145 extends through upper contact trip 141.

Adjuster 145 may have a handle 145K for moving adjuster 145. Handle 145K may in turn carry a screw 145S, which may contact upper contact trip 141.

If the user desires to change the overall length of the contact trip assembly 140, the user would push adjuster 145 along direction F. The adjuster 145 would then move until its teeth 145T do not engage with the teeth of lower contact trip 142. The user can then move the lower contact trip 142 to the desired position. To lock the desired position, the user would (a) pull or push adjuster 145 along the direction F' in order to engage the teeth. Alternatively, the user may rotate screw 145S so that it contacts upper contact trip 141, and moves adjuster 145 along direction F'.

As before, adjuster 145 may have a cam ramp (not shown) that contacts upper contact trip 141. Such cam ramp is preferably arranged so that it takes up any clearance or gaps when adjuster 145 is in the engaged position.

Persons skilled in the art should recognize that it is preferred to move the adjuster 145 along a direction substantially parallel to the teeth 145T and/or substantially perpendicular to the direction of movement for the contact trip assembly 140. However, such persons will also recognize that the movement of adjuster 145 can be changed to meet other technical, ergonomic or preferential requirements. For example, teeth 145T may be inclined relative to the direction of movement of adjuster 145, in order to increase the contact area between the teeth. In such case, the adjuster 145 could move along a direction substantially perpendicular to the direction of movement for the contact trip assembly 140, yet in a direction that is not parallel to the teeth 145T.

Persons skilled in the art should realize that adjuster 145 may be disposed on lower contact trip 142 to engage the upper contact trip 141.

As before, it may also be useful to provide adjuster 145 with a protrusion (not shown) that engages a notch 13N in nosepiece 13 when adjuster 145 is moved to the disengaged position. In this manner, the upper contact trip 141 cannot move upwardly and unintendedly engage the trigger assembly 14 during adjustment. Persons skilled in the art will recognize that the same result will be achieved if adjuster 145 is provided with a notch that engages a protrusion on the nosepiece.

It may also be useful to provide lower contact trip 142 with a protrusion (not shown) which is received within a slot (not shown) in upper contact trip 141. Such protrusion will slide along the slot and limit the vertical movement of lower contact trip 142 when adjuster 145 is disengaged. Accordingly, the protrusion may also prevent the lower contact trip 142 from becoming disconnected from upper contact trip 141. Persons skilled in the art will recognize that the same result will be achieved if lower contact trip 141 is provided with a slot that receives a protrusion on upper contact trip 141.

FIGS. 4–8 illustrate another embodiment of the invention, where like numerals refer to like parts. The teachings of the previous embodiments discussed above are fully incorporated herein. This embodiment may be especially useful when an adjustable wireform contact trip is desirable.

Referring to FIGS. 4–8, tool 10 is provided with an adjustable contact trip assembly 200. The contact trip assembly 200 preferably has an upper contact trip 201 for engaging trigger assembly 14 and a lower contact trip 202 for contacting a workpiece. The contact trip assembly 200 is preferably slidably attached to the housing 15 and/or nosepiece 13 so that it slides vertically when the lower contact trip 202 contacts a workpiece W and the user pushes the fastening tool 10 unto the workpiece W.

Lower contact trip 202 may include a wire 202W which contacts the workpiece as discussed above. Lower contact trip 202 is preferably disposed within upper contact trip 201.

Figure 8:
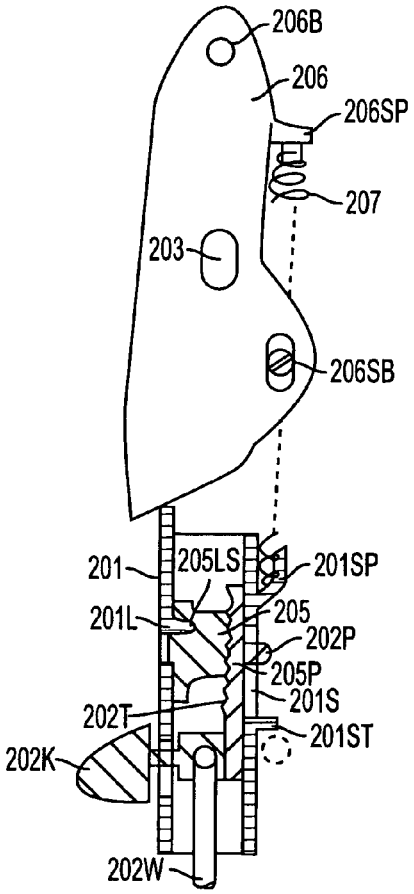
FIG. 8 is a partial cross-sectional view of the contact trip assembly of FIG. 4, along line B—B as shown in FIG. 7A.

Upper contact trip 201 may carry an adjuster 205. As shown in FIG. 8, upper contact trip 201 may have a lip 201L that is received in a slot 205SL in adjuster 205. Upper contact trip 201 and adjuster 205 may have other features, such as the lip 201L and slot 205SL, for locking the vertical position of the adjuster 205 relative to the upper contact trip 201, as shown in FIG. 8. The lip/slot combination and the other features however should allow the adjuster 205 to move towards and away the upper contact trip 201 along a horizontal axis 205A, which is preferably the longitudinal axis of adjuster 205. Persons skilled in the art will know how to design the upper contact trip 201 and adjuster 205 to achieve such result.

Preferably adjuster 205 have teeth 205T for meshing with teeth 202T disposed on lower contact trip 202. This connection may be disposed within upper contact trip 201 as shown in FIG. 8.

Furthermore, a spring 204 may be disposed between upper contact trip 201 and adjuster 205 for biasing adjuster 205 away from upper contact trip 201 and preferably towards a meshing position. Adjuster 205 may have an inset boss 205B for receiving spring 204.

The upper contact trip 201/lower contact trip 202 assembly may be disposed within a cover 206, which is connected to the housing 15. A button 203 is preferably disposed between upper contact trip 201 and cover 206 for moving adjuster 205. Button 203 may be directly connected to adjuster 205 so that they move in conjunction, e.g., a press-fit junction or a friction junction. Preferably, button 203 is not mechanically connected to adjuster 205.

Button 203 may be kept within cover 206 by a flange 203F which prevents button 203 from escaping. Because adjuster 205 contacts button 203, spring 204 in effect biases button 203 outwardly. Persons skilled in the art shall recognize that button 203 may be disposed directly on upper contact trip 201 or in any other place so long as it can move adjuster 205.

Preferably cover 206 is connected to housing 15 via bolts 206 and stop bolt 206SB.

Figure 7A:
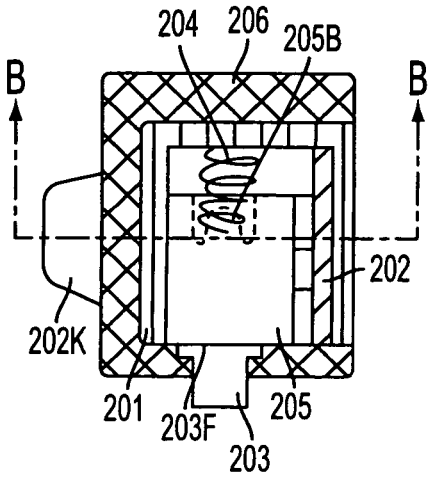
FIG. 7 is a cross-sectional view of the contact trip assembly of FIG. 4, along line A—A as shown in FIG. 4.
Figure 7B:
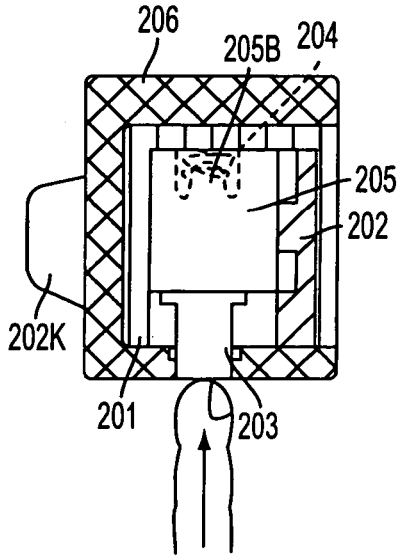

FIG. 7A shows adjuster 205 meshing with lower contact trip 202. If the user desires to change the overall length of the contact trip assembly 200, the user would push button 203 as shown in FIG. 7B. The button 203 moves adjuster 205 until its teeth 205T do not engage with the teeth 202T of lower contact trip 202. The user can then move the lower contact trip 202 to the desired position and let go of button 203. Spring 204 will move button 203 and adjuster 205 outwardly back to the meshing position.

Persons skilled in the art should realize that adjuster 205 may be disposed on lower contact trip 202 to engage the upper contact trip 201.

It may be useful to provide lower contact trip 202 with a protrusion 202P which is received within a slot 201S in upper contact trip 201. Such protrusion 202P will slide along the slot and limit the vertical movement of lower contact trip 202. Accordingly, the protrusion 202P may also prevent the lower contact trip 202 from becoming disconnected from upper contact trip 201. Persons skilled in the art will recognize that the same result will be achieved if lower contact trip 201 is provided with a slot that receives a protrusion on upper contact trip 201.

It may also be useful to provide the cover 206 and upper contact trip 201 with protrusions 206SP, 201SP, respectively. A spring 207 can then be disposed therebetween. Spring 207 would thus bias upper contact trip (and thus contact trip assembly 200) downwardly towards the workpiece W.

In addition, it may be useful to provide upper contact trip 201 with protrusion 201 ST. Protrusion 201 ST would limit the downward movement of contact trip 200 by contacting stop bolt 206SB when the contact trip assembly has moved to the downward limit.

It may also be useful to provide the lower contact trip 202 with a knob 202K. The user could use knob 202K to adjust lower contact trip 202 while pressing button 203. Preferably knob 202K can move vertically along a slot 201KS of upper contact trip 201 and slot 206S of cover 206, when lower contact trip 201 is being vertically adjusted. Knob 202K and cover 206 may have indicia 202KI and 206I, respectively, which indicate the relative length of the contact trip assembly 200.

Preferably, button 203 engages lip 201L when pushed towards the disengaged position. Such engagement prevents upper contact trip 201 from moving upwardly and unintendedly engaging the trigger assembly 14 during adjustment.

Figure 15:
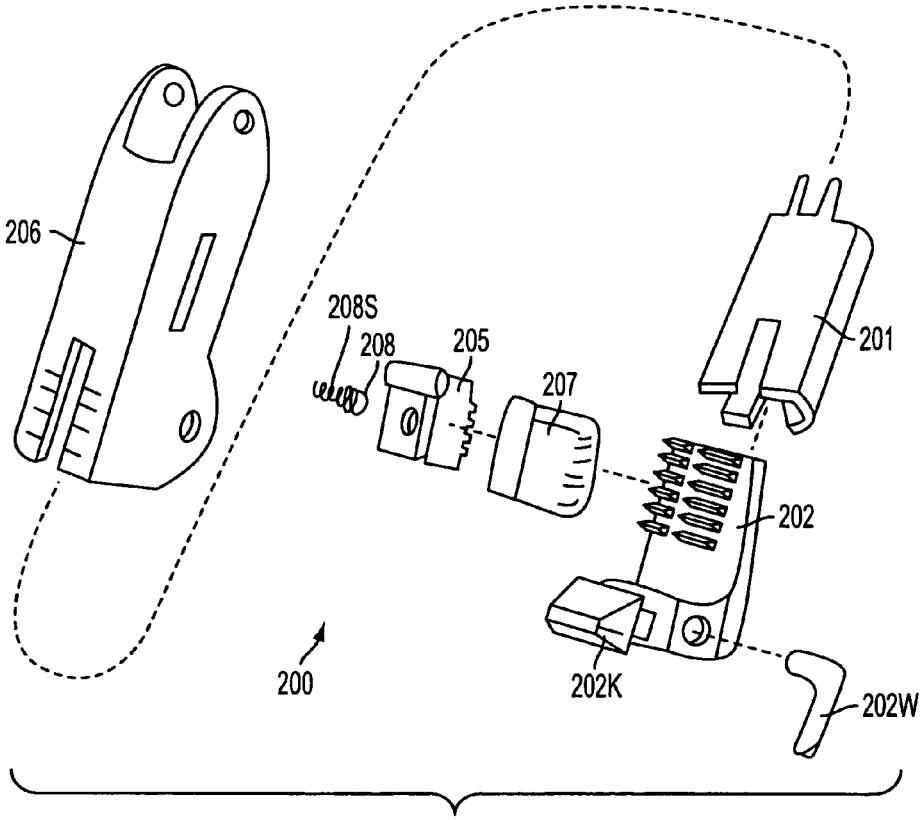
FIG. 15 is an exploded view of another embodiment of a contact trip assembly according to the invention.
Figure 16A:
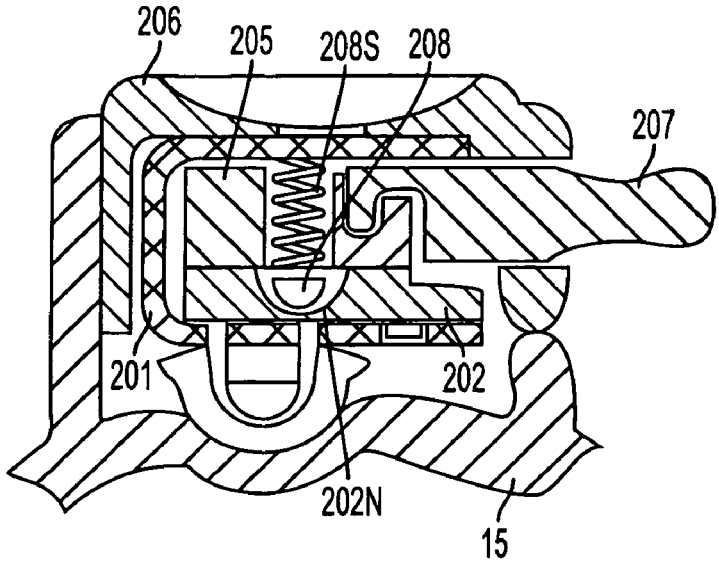
FIGS. 16A–B show the engaged and disengaged contact trip assembly, respectively.
Figure 16B:
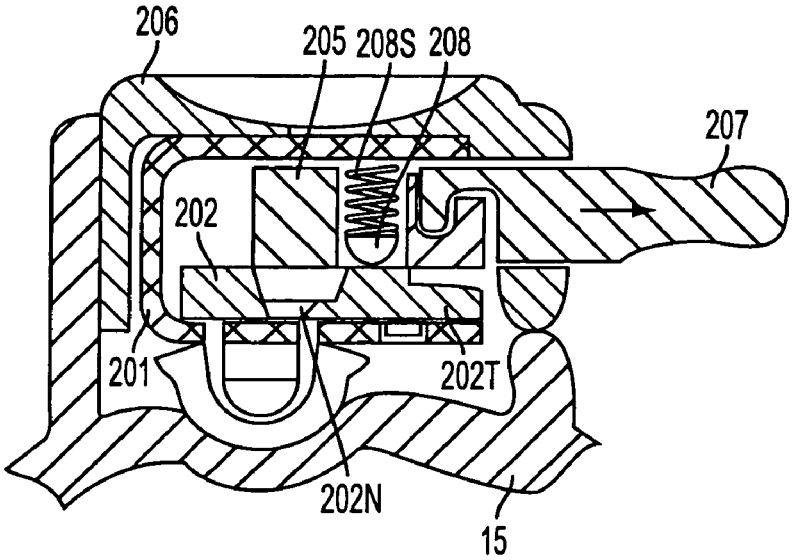
Figure 17A:
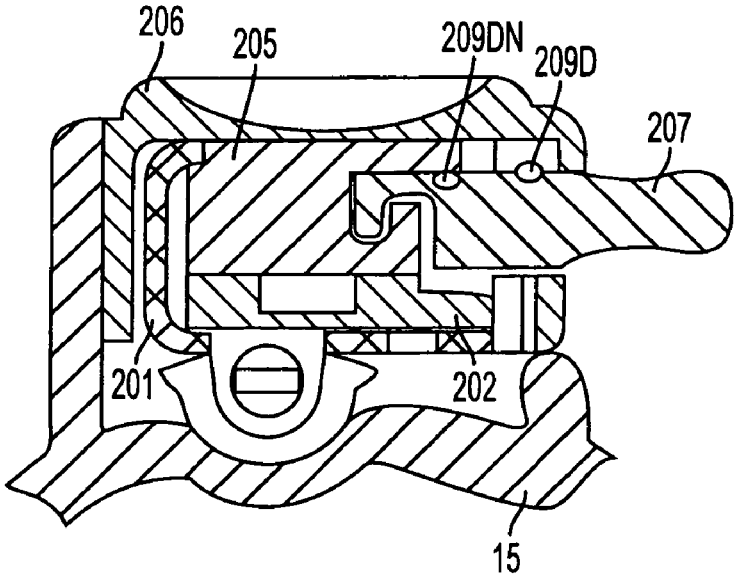
FIGS. 17A–B show the engaged and disengaged contact trip assembly, respectively.
Figure 17B:
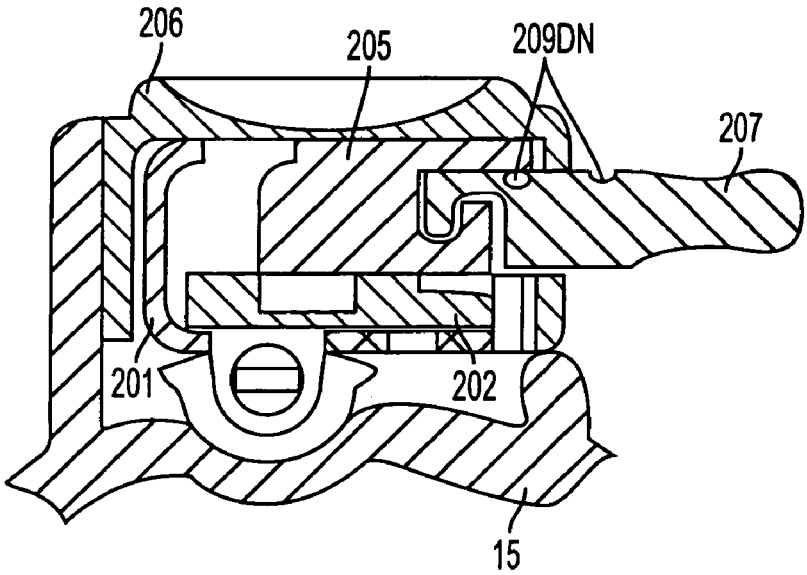

FIGS. 15–17 illustrate other embodiments of the invention, where like numerals refer to like parts. In particular, the embodiment of FIGS. 15–16 is very similar to the embodiment of FIGS. 4–8, and only vary slightly. Nevertheless, the teachings of the embodiments discussed above are fully incorporated herein.

One of the differences is that a button 207 is slidably attached to the adjuster 205. Button 207 can move axially with adjuster 205 between the engaged and disengaged positions. However, button 207 is captured by cover 206, so that button 207 remains stationary relative thereto while adjuster 205 move vertically along upper and lower contact trips 201, 202.

With such construction, FIG. 16A shows adjuster 205 meshing with lower contact trip 202. If the user desires to change the overall length of the contact trip assembly 200, the user would pull button 207 towards the position of FIG. 16B. The button 207 moves adjuster 205 until its teeth 205T do not engage with the teeth 202T of lower contact trip 202. The user can then move the lower contact trip 202 to the desired position.

To fix the desired length of contact trip assembly 200, the user then needs to push button 207 (and adjuster 205) to the position shown in FIG. 16A. Persons skilled in the art will recognize that this movement is necessary as no spring 204 is provided to move adjuster 205 outwardly back to the meshing position.

It may be desirable to provide a detent mechanism to maintain the adjuster 205 in the meshing and/or disengaged positions. Accordingly, adjuster 205 may be provided with a bore to receive detent 208 and spring 208S, which biases detent 208 against a detent notch 202N on lower contact trip 202. Detent 208 may contact the teeth 202T when in the adjuster 205 is in the disengaged position.

Persons skilled in the art shall recognize that the detent and notch combination may be disposed on any two continguous members that move relative to each other in the meshing and disengaged positions. For example, a detent mechanism may be provided between button 207 and cover 206, as shown in FIG. 17. Persons skilled in the art should recognize that the embodiment of FIG. 17 is very similar to the embodiment of FIGS. 15–16 and that like numerals refer to like parts. Nevertheless, the teachings of the embodiments discussed above are fully incorporated herein.

As shown in FIG. 17, cover 206 may have a detent 209, which engages notches 209DN disposed on button 207. Preferably, button 207 and/or detent 209 are made of a resilient material, such as plastic, so that the detent mechanism does not bar all movement of button 207 relative to cover 206. Persons skilled in the art should recognize that detent 209D and detent notch 209DN could have been placed on the button 207 and cover 206, respectively.

Figure 19:
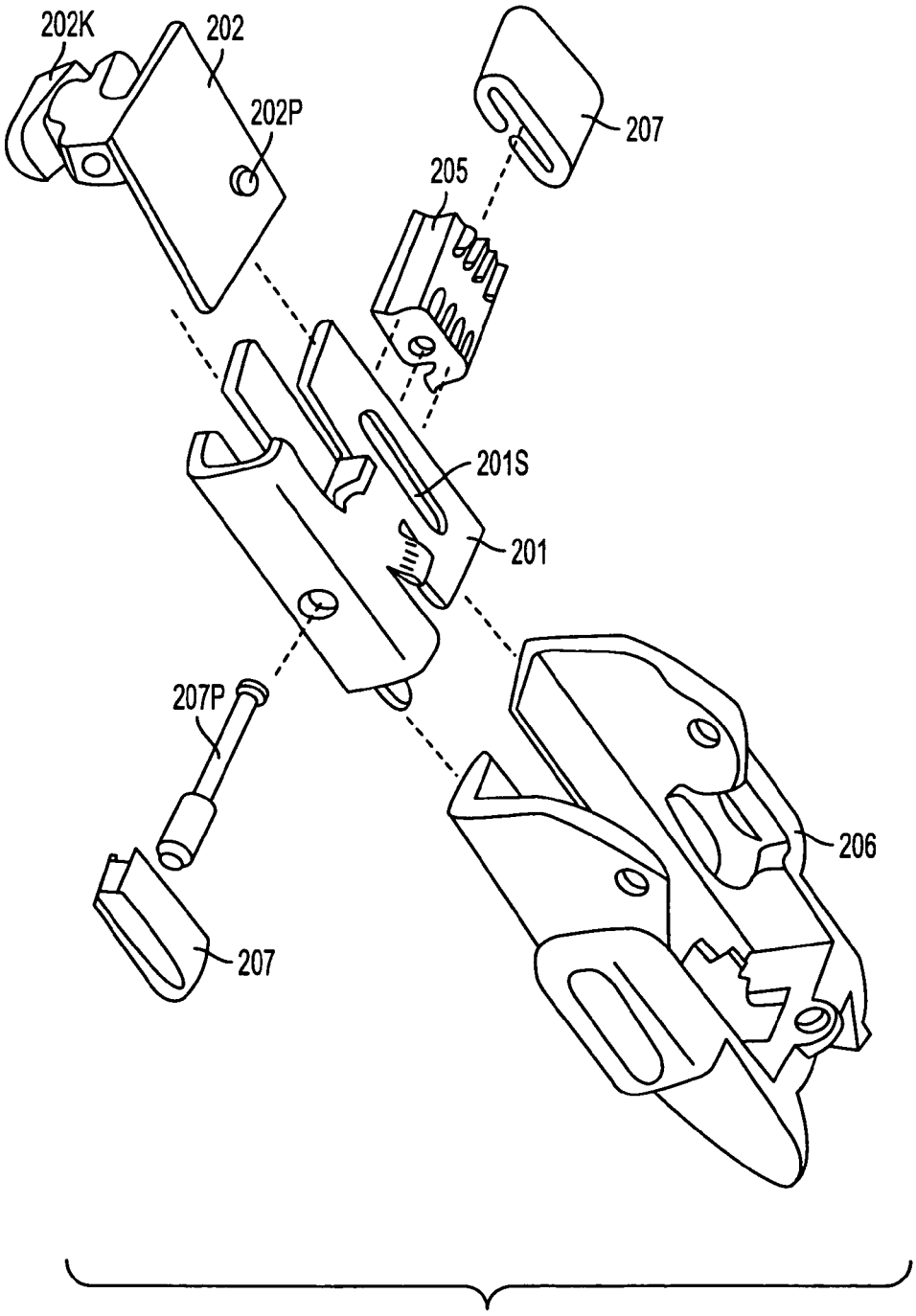
FIG. 19 is an exploded view of a further embodiment of a contact trip assembly according to the invention.

FIGS. 19–20 illustrate another embodiment of the invention, where like numerals refer to like parts. In particular, the embodiment of FIGS. 19–20 is very similar to the embodiment of FIGS. 4–8, and only vary slightly. Nevertheless, the teachings of the embodiments discussed above are fully incorporated herein.

One of the differences is that two buttons 207 are slidably attached to the adjuster 205 via a pin 207P. Buttons 207 have channels that slidably receive pin 207P, so that pin 207P can slide therein. Buttons 207 can move axially with adjuster 205 between the engaged and disengaged positions. However, buttons 207 are captured by cover 206, so that buttons 207 remain stationary relative thereto while adjuster 205 move vertically along upper and lower contact trips 201, 202.

Figure 20A:
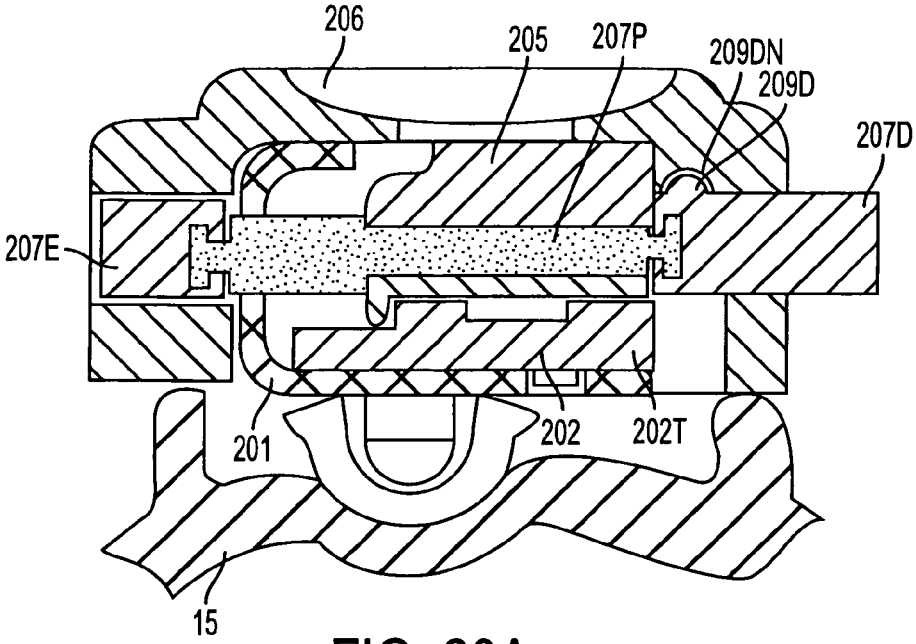
FIGS. 20A–B show the engaged and disengaged contact trip assembly, respectively.
Figure 20B:
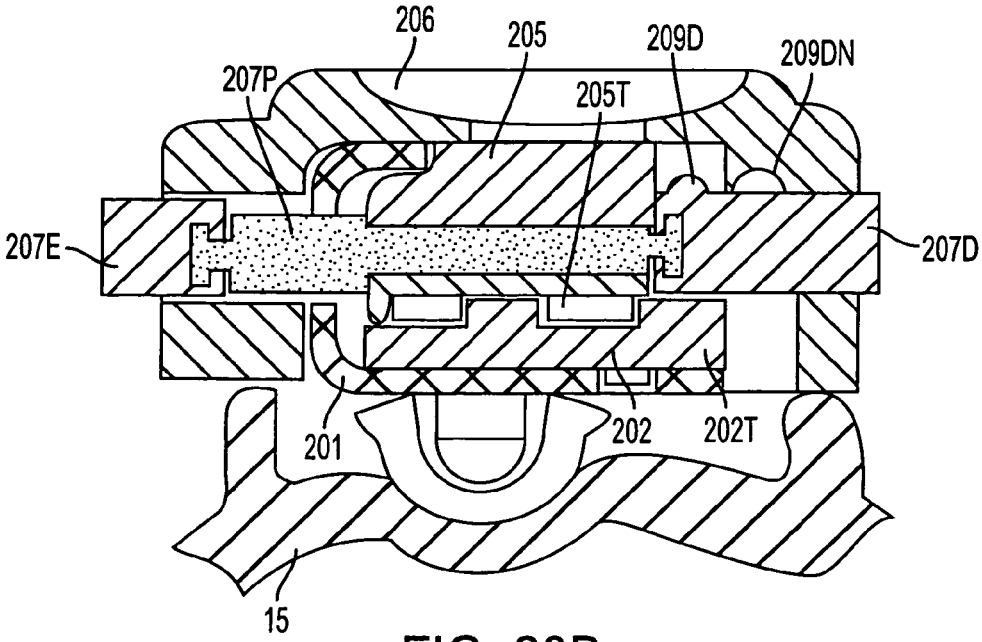

With such construction, FIG. 20A shows adjuster 205 meshing with lower contact trip 202. If the user desires to change the overall length of the contact trip assembly 200, the user would push disengaging button 207D towards the position of FIG. 20B. The button 207D moves adjuster 205 until its teeth 205T do not engage with the teeth 202T of lower contact trip 202. The user can then move the lower contact trip 202 to the desired position.

To fix the desired length of contact trip assembly 200, the user then needs to push engaging button 207E (and adjuster 205) to the position shown in FIG. 20A. Persons skilled in the art will recognize that this movement is necessary as no spring 204 is provided to move adjuster 205 outwardly back to the meshing position.

As mentioned above, it may be desirable to provide a detent mechanism to maintain the adjuster 205 in the meshing and/or disengaged positions. Accordingly, detent 209D can be placed on at least one button 207. Detent 209D would then engage a detent notch 209DN placed on cover 206.

Figure 21A:
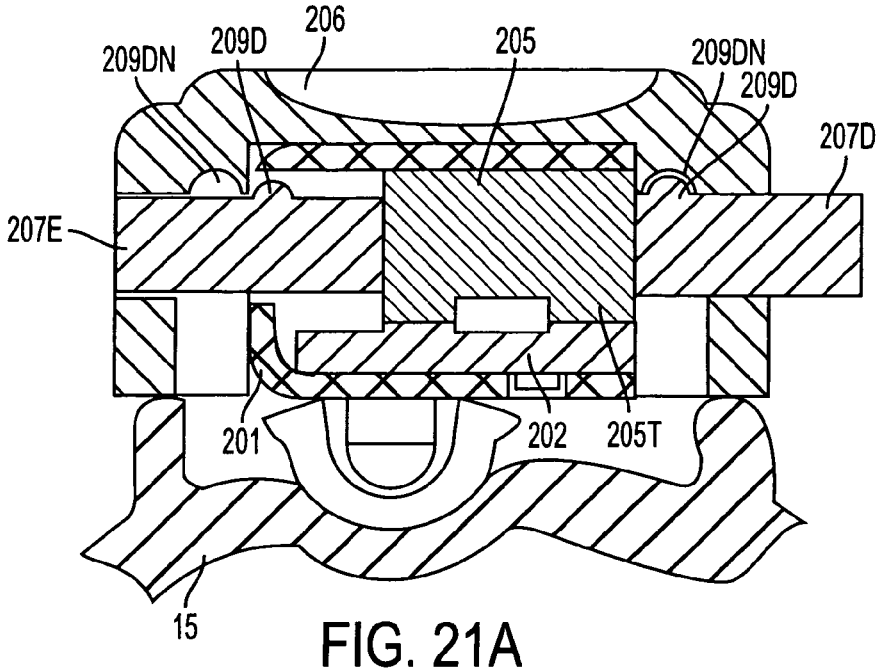
FIGS. 21A–B show the engaged and disengaged contact trip assembly, respectively.
Figure 21B:
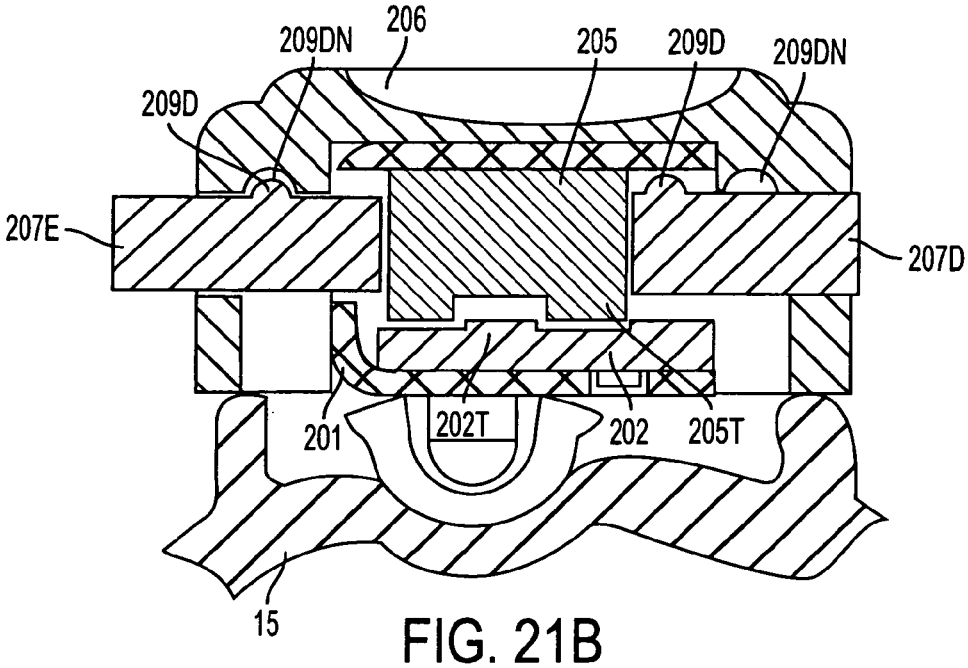

FIG. 21 illustrates yet another embodiment of the invention, where like numerals refer to like parts. In particular, the embodiment of FIG. 21 is very similar to the embodiment of FIGS. 19–20, and only vary slightly. Nevertheless, the teachings of the embodiments discussed above are fully incorporated herein.

One of the differences is that two buttons 207 are not slidably attached to the adjuster 205 via a pin 207P. Instead, buttons 207 just contact surfaces of adjuster 205, so that buttons 207 can move adjuster 205 between the meshing and disengaged positions. However, buttons 207 are captured by cover 206, so that buttons 207 remain stationary relative thereto while adjuster 205 move vertically along upper and lower contact trips 201, 202.

With such construction, FIG. 20A shows adjuster 205 meshing with lower contact trip 202. If the user desires to change the overall length of the contact trip assembly 200, the user would push disengaging button 207D towards the position of FIG. 20B. The button 207D moves adjuster 205 until its teeth 205T do not engage with the teeth 202T of lower contact trip 202. The user can then move the lower contact trip 202 to the desired position.

To fix the desired length of contact trip assembly 200, the user then needs to push engaging button 207E (and adjuster 205) to the position shown in FIG. 20A. Persons skilled in the art will recognize that this movement is necessary as no spring 204 is provided to move adjuster 205 outwardly back to the meshing position.

FIG. 18 illustrates another embodiment of the invention, where like numerals refer to like parts. In particular, the embodiment of FIG. 18 is very similar to the embodiment of FIG. 21, and only vary slightly. Nevertheless, the teachings of the embodiments discussed above are fully incorporated herein.

One of the differences is that engaging button 207E is fixedly attached (or integral with) adjuster 205. In addition, disengaging button 207D contacts a surface of adjuster 205. Further, disengaging buttons 207D is captured by cover 206, so that it remains stationary relative thereto while adjuster 205 move vertically along upper and lower contact trips 201, 202. A spring 207DS may be disposed between adjuster 205 and disengaging button 207D to bias button 207D outwardly of cover 206.

Figure 18A:
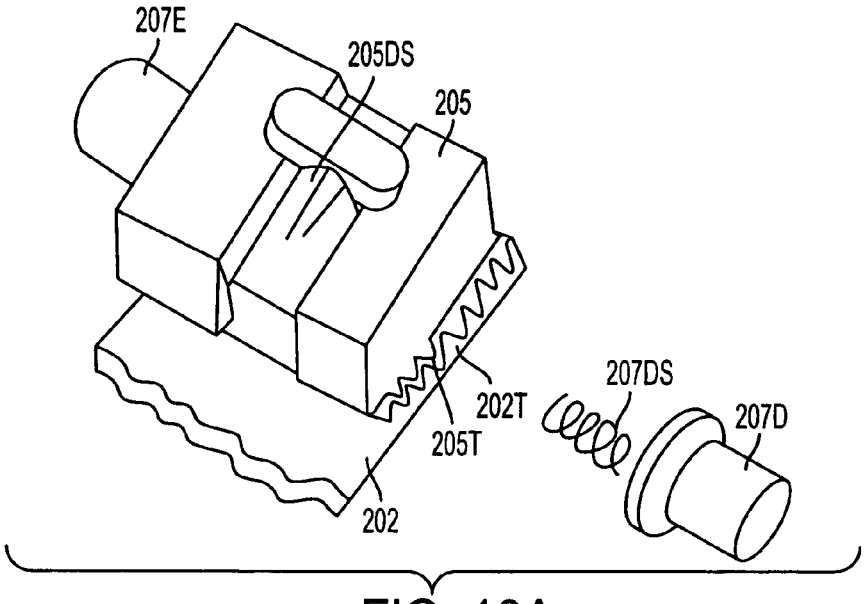
FIG. 18A is a partial exploded view.
Figure 18B:
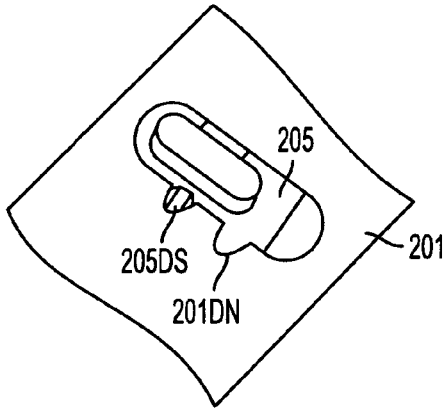
FIG. 18B is a partial assembled view.
Figure 18C:
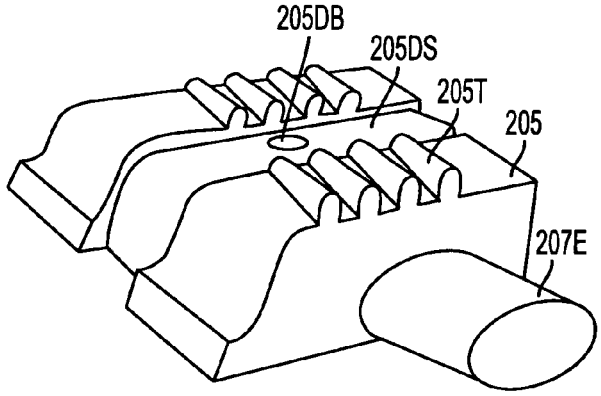
FIG. 18C is a perspective view of an adjuster and FIG. 18D is a perspective view of a detent spring.
Figure 18D:
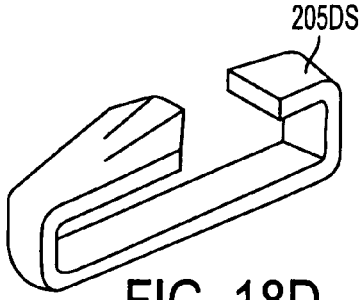

With such construction, FIG. 18A shows adjuster 205 meshing with lower contact trip 202. If the user desires to change the overall length of the contact trip assembly 200, the user would push disengaging button 207D. The button 207D moves adjuster 205 until its teeth 205T do not engage with the teeth 202T of lower contact trip 202. The user can then move the lower contact trip 202 to the desired position.

To fix the desired length of contact trip assembly 200, the user then needs to push engaging button 207E (and adjuster 205) to the position shown in FIG. 18A. Persons skilled in the art will recognize that this movement is necessary as no spring 204 is provided to move adjuster 205 outwardly back to the meshing position.

As mentioned above, it may be desirable to provide a detent mechanism to maintain the adjuster 205 in the meshing and/or disengaged positions. Accordingly, a leaf spring 205DS may be wrapped around adjuster 205. One end of spring 205DS may be folded to create a detent that engages notches 201N formed on the upper contact trip 201.

Spring 205DS may also have a detent bump 205DB. This bump 205DB would not necessarily maintain the adjuster 205 in the meshing or disengaged positions. Bump 205DB however would contact teeth 202T when the adjuster 205 is being moved between positions, providing an audible and/or tactile signal to the user.

Figure 22A:
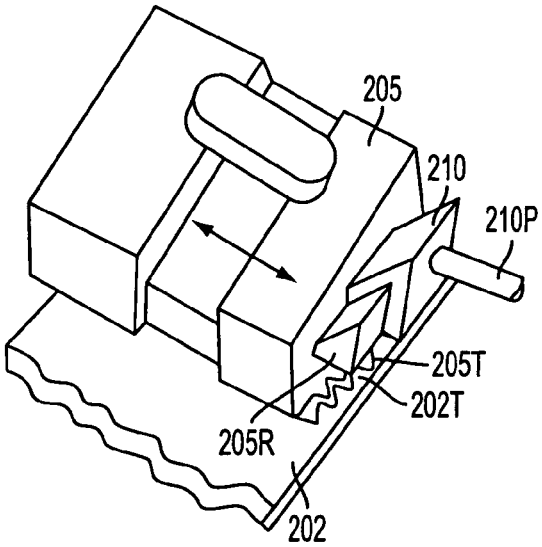
FIG. 22A shows a partially assembled contact trip.
Figure 22B:
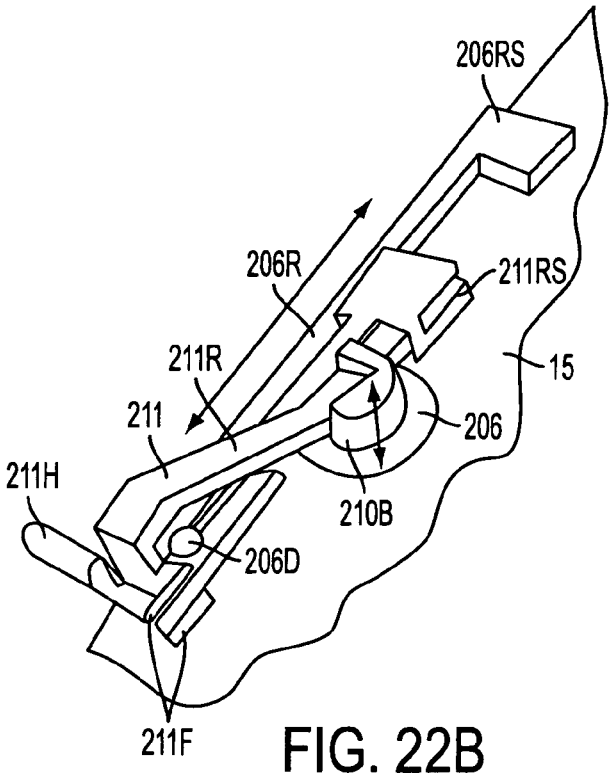
FIG. 22B shows a perspective view of the outside of the contact trip assembly.
Figure 22C:
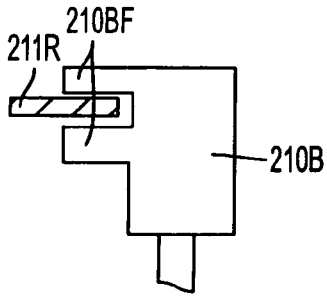
FIG. 22C is a partial cross-section showing the interaction between the button and the cam rail.

Persons skilled in the art should recognize that adjuster 205 may have a rail that slidably receives a button, so that the user can move adjuster 205 by pulling and pushing the button. FIG. 22 illustrates one such possible embodiment, where like numerals refer to like parts. Nevertheless, the teachings of the embodiments discussed above are fully incorporated herein.

Adjuster 205 may have a rail 205R, which is slidably engaged a connector 210. Rail 205R may be shaped as a dovetail.

Preferably, connector 210 can remain stationary along a vertical axis when adjuster 205 moves along the vertical axis, but moves with adjuster 205 when adjuster 205 moves along a horizontal axis. This is achieved by the dovetail connection, which allows adjuster 205 to move along the vertical axis through connector 210, without forcing vertical movement unto connector 210. In addition, the dovetail connection requires adjuster 205 and connector 210 to move together along the horizontal axis between the engaged and disengaged positions.

Connector 210 has a post 210P, which is in turn connected to a button 210B. An activator 211 is used to move the button 210B (and adjuster 205) between the engaged and disengaged positions.

Activator 211 is slidably attached to the cover 206 so that it can be moved along a vertical axis. In particular, activator 211 may have flanges 21 IF for capturing a cover rail 206R therein, allowing activator 211 to slide along the rail 206R. The range of movement may be limited at one end by a rail stop 206RS, which may be engaged by a rail stop 21 IRS. At the other end, activator 211 may be detented in two positions by detents 206D on cover 206. Activator 211 may have a handle 211H for moving the activator 211.

Activator 211 may also have an inclined rail 211R that is captured between two flanges 210BF of button 210B. Accordingly, the linear motion of activator 211 as it slides along cover 206 is translated into a substantially perpendicular motion as button 210B follows rail 211R. Persons skilled in the art will recognize that adjuster 205 will move between the engaged and disengaged positions as button 210B follows rail 211R.

With such construction, if the user desires to change the overall length of the contact trip assembly 200, the user would push activator 211. Due to the interaction between rail 211R and button 210B, button 210B will move adjuster 205 until its teeth 205T do not engage with the teeth 202T of lower contact trip 202. The user can then move the lower contact trip 202 to the desired position. To fix the desired length of contact trip assembly 200, the user then needs to move activator 211 to its original position. Persons skilled in the art will recognize that this movement is necessary as no spring 204 is provided to move adjuster 205 outwardly back to the engaged position.

Figure 26A:
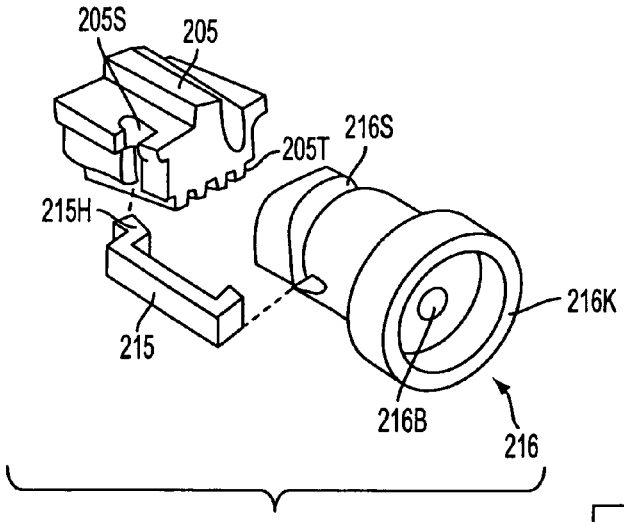
FIGS. 26A–B show a partial exploded view of the contact trip assembly and a cross-sectional view of the assembled contact trip assembly, respectively.

FIG. 26 illustrates yet another embodiment of the invention, where like numerals refer to like parts. Nevertheless, the teachings of the embodiments discussed above are fully incorporated herein.

In this embodiment, an adjustment knob 216 is used to move adjuster 205 between the engaged, or meshing, and disengaged positions. Basically, knob 216 has a body 216K, which is engaged to a housing 216H. Preferably, housing 216H is made of plastic. Body 216K and housing 216H may be engaged via a bolt 216B. Body 216K and/or housing 216H preferably have a helical slot 216S.

Slot 216S is preferably engaged by one end of follower 215. Follower 215 may be captured by housing 216H. Upon rotation of knob 216, follower 215 follows slot 216S, thus moving along its longitudinal axis, rather than rotating about knob 216. In other words, the rotational motion of knob 216 is converted into linear motion of follower 215.

Figure 26B:
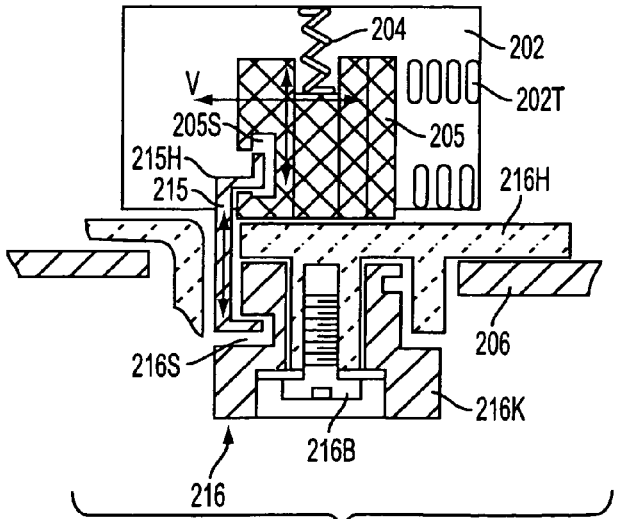

At its other end, follower 215 preferably has a hook 215H, which may be disposed within slot 205S of adjuster 205. Preferably, hook 215H is not captured by slot 205S. As shown in FIG. 26B, it is preferable to provide enough clearance between adjuster 205 and hook 215H so that adjuster 205 can move along vertical axis V without catching hook 215H. Adjuster 205 however will catch hook 215 if knob 216 is rotated.

With such construction, if the user desires to change the overall length of the contact trip assembly 200, the user would rotate knob 216. Due to the interaction between slot 216S and follower 215, knob 216 will move follower 215 until it contacts adjuster 205, then follower 215 and adjuster 205 will move jointly until its teeth 205T do not engage with the teeth 202T of lower contact trip 202. The user can then move the lower contact trip 202 to the desired position. Persons skilled in the art will recognize that a user will not be able to move adjuster 205 and upper contact trip 201 along vertical axis V because of follower 215.

To fix the desired length of contact trip assembly 200, the user then needs to rotate knob 216 to its original position. Persons skilled in the art will recognize that such arrangement obviates the need for spring 204. While spring 204 is not requires to move adjuster 205 outwardly back to the engaged position, it can still provide a force to maintain engagement between teeth 202T, 205T.

Persons skilled in the art will recognize that it may be desirable to provide a detent for knob 216, which would maintain the knob 216 in the engaged and/or disengaged positions.

Figure 9:
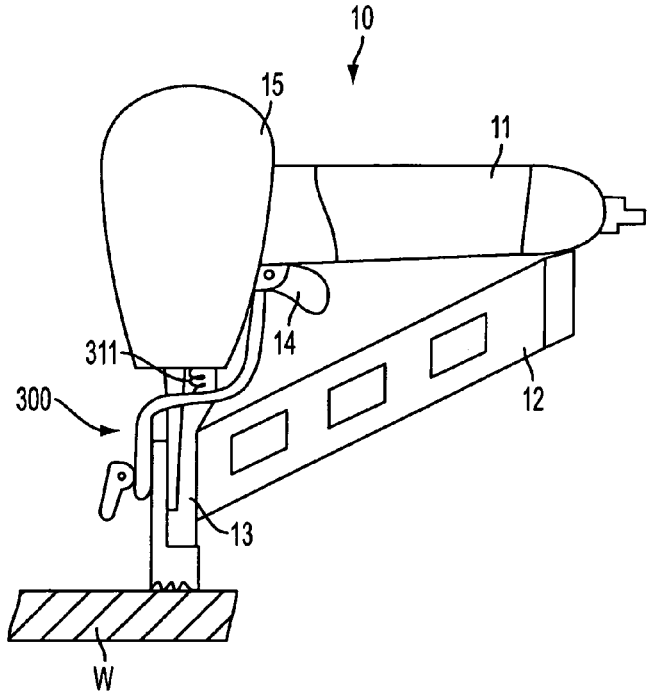
FIG. 9 is a side view of a fastening tool including a further embodiment of a contact trip assembly according to the invention.
Figure 10:
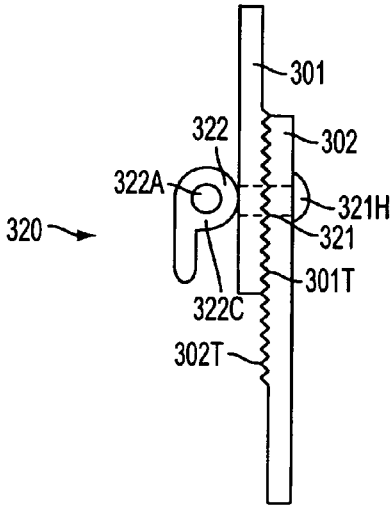
FIG. 10 is a side view of the contact trip assembly of FIG. 9.
Figure 11:
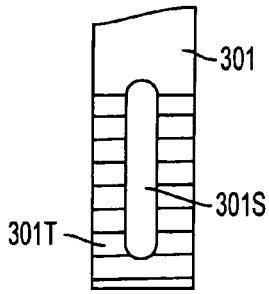
FIG. 11 is a rear view of the upper contact trip of FIG. 9.

FIGS. 9–11 illustrate a further embodiment of the invention, where like numerals refer to like parts. The teachings of the embodiments discussed above are fully incorporated herein. Tool 10 is provided with an adjustable contact trip assembly 300. The contact trip assembly 300 preferably has an upper contact trip 301 for engaging trigger assembly 14 and a lower contact trip 302 for contacting a workpiece W. The contact trip assembly 300 is preferably slidably attached to the housing 15 and/or nosepiece 13 so that it slides vertically when the lower contact trip 302 contacts a workpiece W and the user pushes the fastening tool 10 unto the workpiece W. A spring 311 may be disposed between housing 15 and/or nosepiece 13 and contact trip assembly 300 to bias contact trip assembly 300 downwardly towards the workpiece W.

Upper contact trip 301 and lower contact trip 302 preferably have teeth 301T and 302T, respectively, which mesh together.

A cam mechanism 320 may be used to force teeth 301T and 302T to mesh and/or lock upper contact trip 301 and lower contact trip 302 in place. Cam mechanism 320 may include a shaft 321 extending through upper contact trip 301 and lower contact trip 302. The shaft 321 may have a head 321H disposed on the side of lower contact trip 302 farthest from upper contact trip 301. A cam 322 may be pivotally connected to shaft 321 and have a cam portion 322C that contacts upper contact trip 301.

With such arrangement, cam portion 322C changes the distance between cam pivot 322A and upper contact trip 301 when cam 322 is pivoted about an axis substantially perpendicular to the longitudinal axis of shaft 321. If the user desires to change the overall length of the contact trip assembly 300, the user would rotate the cam 322, thus unmeshing teeth 301T, 302T, and move the lower contact trip 302 to the desired position. The user would then rotate cam 322 back to the locking position.

It may be useful to provide upper contact trip 301 with a slot 301S to allow shaft 321 (and thus lower contact trip) to move vertically therein relative to upper contact trip 301.

Persons skilled in the art will recognize that cam mechanism 322 may be disposed so that shaft 321 is captured by upper contact trip 301, rather than lower contact trip 302, and/or that cam 322 contact lower contact trip 302, rather than upper contact trip 301.

Figure 12:
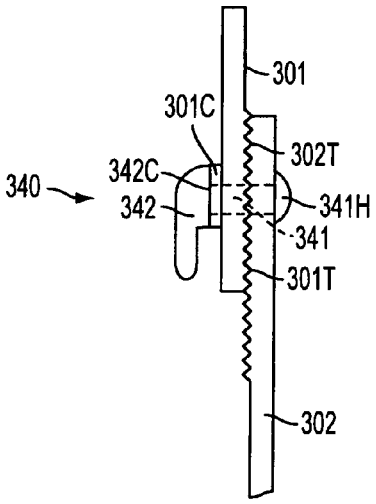
FIG. 12 is a side view of another contact trip assembly according to the invention.
Figure 13:
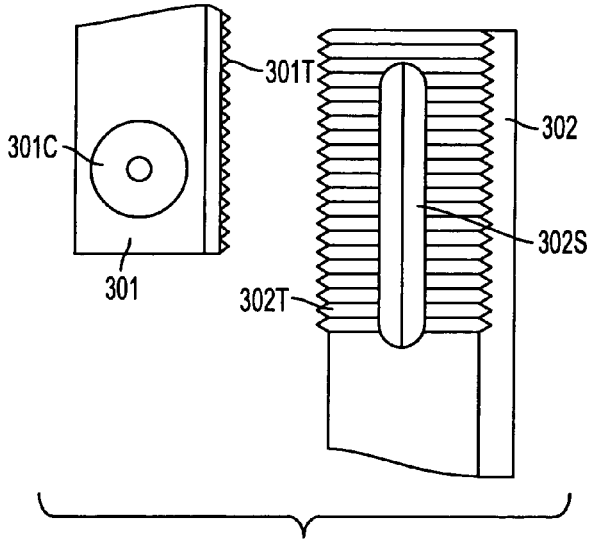
FIG. 13 is a partial exploded view of the contact trip assembly of FIG. 12.

FIGS. 12–13 illustrate an alternative cam mechanism 340, where like numerals refer to like parts. The teachings of the embodiments discussed above are fully incorporated herein.

A cam mechanism 340 may be used to force teeth 301T and 302T to mesh and/or lock upper contact trip 301 and lower contact trip 302 in place. Cam mechanism 340 may include a shaft 341 extending through upper contact trip 301 and lower contact trip 302. The shaft 341 may have a head 341H disposed on the side of lower contact trip 302 farthest from upper contact trip 301. A cam 342 may be fixedly connected to shaft 341 so that shaft 341 and cam 342 rotate jointly about the longitudinal axis of shaft 341. Cam 342 may have a cam portion 342C that contacts cam portion 301C of upper contact trip 301.

With such arrangement, cam portion 342C changes the distance between cam portion 342C and lower contact trip 302 when cam 342 is pivoted. If the user desires to change the overall length of the contact trip assembly 300, the user would rotate the cam 342, thus unmeshing teeth 301T, 302T, and move the lower contact trip 302 to the desired position. The user would then rotate cam 342 back to the locking position.

It may be useful to provide contact trip 302 with a slot 302S to allow shaft 341 (and thus lower contact trip 302) to move vertically therein relative to upper contact trip 301.

Persons skilled in the art may recognize other alternatives to the means disclosed herein. However, all these additions and/or alterations are considered to be equivalents of the present invention.

What is claimed is:

1. A fastening tool comprising:

a housing;

a magazine connected to the housing for storing a fastener;

a driving mechanism disposed within the housing for driving the fastener into a workpiece;

a trigger assembly pivotally attached to the housing for activating the driving mechanism, the trigger assembly comprising a main trigger pivotally attached to the housing, and a supplemental trigger pivotally attached to the main trigger;

a contact trip assembly comprising an upper contact trip contacting the supplemental trigger, and a lower contact trip connected to the upper contact trip, said contact trip assembly moving along a first direction substantially vertically to move at least one of the main trigger and the supplemental trigger;

an adjuster supported by one of the upper contact trip and the lower contact trip, the adjuster having teeth that can mesh with teeth disposed on the other of the upper contact trip and the lower contact trip, the adjuster being movable between a first position where the teeth of the adjuster and the other of the upper contact trip and the lower contact trip mesh, and a second position where the teeth of the adjuster and the other of the upper contact trip and the lower contact trip do not mesh, wherein the adjuster moves between the first and second positions along a second direction substantially perpendicular to the first direction;

a knob rotatably attached to the housing;

a link connected to the adjuster at one end and to the knob at the other end for moving the adjuster between the first and second positions upon rotation of the knob.

2. The fastening tool of claim 1, wherein the knob has a channel for slidably receiving the link.

* * * * *